US010126060B2

(12) United States Patent
Taylor

(10) Patent No.: US 10,126,060 B2
(45) Date of Patent: Nov. 13, 2018

(54) LANCE DRIVE SYSTEM

(71) Applicant: Opta Minerals, Inc., Waterdon (CA)

(72) Inventor: Curtis Taylor, Chagrin Falls, OH (US)

(73) Assignee: Opta Minerals Inc., Waterdon (CA)

( * ) Notice: Subject to any disclaimer, the term of this patent is extended or adjusted under 35 U.S.C. 154(b) by 182 days.

(21) Appl. No.: 15/141,952

(22) Filed: Apr. 29, 2016

(65) Prior Publication Data

US 2016/0320132 A1 Nov. 3, 2016

Related U.S. Application Data

(60) Provisional application No. 62/155,815, filed on May 1, 2015, provisional application No. 62/215,408, filed on Sep. 8, 2015, provisional application No. 62/316,786, filed on Apr. 1, 2016.

(51) Int. Cl.

| | |
|---|---|
| ***F27D 3/16*** | (2006.01) |
| ***B22D 1/00*** | (2006.01) |
| ***F27B 3/22*** | (2006.01) |
| ***F27D 19/00*** | (2006.01) |
| ***F27D 21/00*** | (2006.01) |
| ***F27D 27/00*** | (2010.01) |

(52) U.S. Cl.

CPC ..... *F27D 3/16* (2013.01); *B22D 1/005* (2013.01); *F27B 3/22* (2013.01); *F27D 19/00* (2013.01); *F27D 21/00* (2013.01); *F27D 27/00* (2013.01); *F27D 2003/169* (2013.01)

(58) Field of Classification Search

CPC . B22D 1/005; F27B 3/22; F27D 19/00; F27D 2003/169; F27D 21/00; F27D 27/00; F27D 3/16

USPC ..... 266/44, 225, 217, 256

See application file for complete search history.

(56) References Cited

U.S. PATENT DOCUMENTS

| | | | | |
|---|---|---|---|---|
| 4,320,668 | A * | 3/1982 | Honda | G01N 21/314 73/863.11 |
| 4,426,068 | A | 1/1984 | Gimond et al. | |
| 4,695,042 | A | 9/1987 | Kudou | |
| 7,563,406 | B2 | 7/2009 | Rapp | |
| 7,736,415 | B2 | 6/2010 | Colavito et al. | |
| 9,259,780 | B2 * | 2/2016 | Waitlevertch | B22D 1/005 |

FOREIGN PATENT DOCUMENTS

| | | | |
|---|---|---|---|
| JP | 62185811 | A | 8/1987 |
| JP | 62386527 | A | 11/1988 |
| JP | 1073014 | A | 3/1989 |
| JP | 1252720 | A | 10/1989 |
| JP | 2008315 | A | 1/1990 |
| JP | 7083576 | A | 3/1995 |
| JP | 10195522 | A | 7/1998 |
| JP | 10204520 | A | 8/1998 |
| JP | 3641130 | B2 | 4/2005 |
| KR | 1092070 | B1 | 7/2003 |

* cited by examiner

*Primary Examiner* — Scott R Kastler
*Assistant Examiner* — Michael Aboagye
(74) *Attorney, Agent, or Firm* — Fay Sharpe LLP

(57) ABSTRACT

A rotary lance drive for moving a lance during the injecting of gas and/or reagents into molten metal.

33 Claims, 13 Drawing Sheets

LANCE DRIVE SYSTEM

The present invention claims priority on U.S. Provisional Application Ser. Nos. 62/155,815 filed May 1, 2015; 62/215,408 filed Sep. 8, 2015; and 62/316,786 filed Apr. 1, 2016, all of which are incorporated herein by reference.

The present invention relates to the treatment of molten metal by injection of reagents and/or gas into the molten metal through an injection lance, more particularly to lance drives for performing such treatment, and still more particularly to rotary lance drives for moving a lance during the injecting of gas and/or reagents into molten metal.

BACKGROUND OF THE INVENTION

A common lance drive comprises a rigid lance mount to which the lance connects. The lance mount allows the lance to be removed from the lance drive and for new lances to be mounted on the drive. One common lance mount configuration is a swing-gate design that is used to clamp the lance into the lance mount of the lance drive. This swing-gate includes a bar that is positioned between two other bars. A pivot runs through the three bars and allows the middle bar to swing open like a gate. Once the lance is mounted, the gate is closed. At the top of the lance is a connection to which the reagent and/or gas pipe or hose is connected. The connection will typically be made with flexible hose. Once the lance is connected to the pipe or hose and the lance is secured in the lance mount, the lance can be driven by the lance drive into the molten metal bath for treatment of iron, steel or other metals. The lance includes one or more openings in the bottom portion to allow the reagent and/or gas to be inserted into the molten metal so as to treat the molten metal. Rotary lance drives generally include a swivel connection at the top of the lance drive to allow for rotation of the lance without twisting the supply pipe or hose.

Non-limiting examples of prior art lance systems are illustrated in U.S. Pat. Nos. 4,320,668; 4,426,068; 4,695,042; 7,563,406; 7,736,415; 9,259,780; JP 1073014A; JP 1252720A; JP 2008315A; JP 3641130B2; JP 7083576A; JP 10195522A; JP 10204520A; JP 62185811A; JP 62386527A; and KR 1092070B1, all of which are incorporated herein by reference.

SUMMARY OF THE INVENTION

The present invention is directed to an improved lance drive system that can be used during the injection of gas and/or reagents into molten metal, and methods for using the same. The lance drive system is configured to move a lance about a vertical axis while simultaneously discharging reagent through the lance. As can be appreciated, the lance drive system can be used with a variety of reagents for treatment of a variety of metals or other materials.

In accordance with various non-limiting embodiments of the present invention, the lance drive system includes a main support housing that includes a main rotary element. The main rotary element is caused to be rotated partially or fully about a main rotation axis by a drive motor assembly. A lance mount arrangement is connected to the main rotary element and is caused to be rotated when the main rotary element rotates. The lance mount arrangement is configured to releaseably connect an injection lance to the lance mount arrangement. In one non-limiting embodiment, the lance drive system is configured to cause the main rotary element to reciprocate such that the main rotary element rotates about the main rotation axis less than 360°. The one or more drive motors of the drive motor assembly can be directly connected to the main rotary element or can be connected to the main rotary element by one or more gears, belts, chains, hydraulic transmission arrangement, etc.

In one non-limiting aspect of the invention, the lance mount arrangement is connected to the main rotary element at a location that is off center from the main rotation axis such that when the main rotary element rotates about the main rotation axis, the lance mount arrangement is caused to move in a circular or semi-circular path that is spaced from and about the main rotation axis. In one non-limiting arrangement, the lance mount arrangement is at least partially connected to and/or positioned on an outer perimeter of the main rotary element. In another non-limiting arrangement, the lance mount arrangement is at least partially rotatably connected to the main support housing at a location above and/or below the main rotary element. In such an arrangement, the axis of rotation of the main rotary element and the portion of the lance mount arrangement that is rotatably connected to the main support housing at a location above and/or below the main rotary element are generally the same.

In another non-limiting aspect of the invention, the lance mount arrangement is connected to the main rotary element at a location that is aligned with the main rotation axis such that when the main rotary element rotates, the lance mount arrangement is caused to rotate within the main rotation axis. In another non-limiting arrangement, the lance mount arrangement is at least partially rotatably connected to the main support housing at a location above and/or below the main rotary element. In such an arrangement, the axis of rotation of the main rotary element and the portion of the lance mount arrangement that is rotatably connected to the main support housing at a location above and/or below the main rotary element are generally the same. In another non-limiting arrangement, the lance is connected to the lance mount arrangement such that the lance is off center from the main rotation axis such that when the main rotary element rotates about the main rotation axis, the lance mount arrangement is caused to move in a circular or semi-circular path that is space from and about the main rotation axis.

In another non-limiting aspect of the invention, a swivel coupling can optionally be used that is configured to permit connection of a supply hose to the lance or other structure so as to allow relative rotation between the supply hose and the lance or other structure. The supply hose can be optionally flexible.

In another non-limiting aspect of the invention, the lance drive system can be configured to cause the lance to reciprocate about a vertical axis and/or move about a vertical axis. The lance drive system can optionally cause the lance to move up and down along the vertical axis. Such vertical movement of the lance can occur while the lance is rotated in or about the main rotation axis; however, this is not required.

In one non-limiting aspect of the present invention, the lance that is connected to the lance mount arrangement is used for the treatment of molten metal material via injection of one or more reagents into the molten metal through such lance. The type of reagent used in conjunction with the lance system of the present invention is non-limiting. Non-limiting examples of such reagents can include fluid reagents, solid reagents, gaseous reagents, etc. In one non-limiting system, the reagent is a desulfurization reagent; however, this is not required. Similarly, the type of lance used in conjunction with the lance drive system of the present invention is non-limiting. In use, the lance is configured to releasably mount to the lance drive system of the present invention, which lance drive system is optionally configured to partially or fully move or rotate the lance about a vertical rotational axis; however, this is not required. Furthermore, the lance drive system can be configured to cause the lance to move up and move down along a vertical axis; however, this is not required. The lance used in conjunction with the lance drive system of the present invention is not limited in cross-sectional shape or size. For example, the cross-sectional shape of the lance can be circular, oval, hexagonal, rectangular, square, etc. Generally, the lance comprises an upper portion defining a top end of the lance, a lower portion defining a bottom end of the lance, and a main passage extending along a vertical axis through said lance. The bottom end of the lance can include one or more discharge ports in fluid communication with the lance conduit for the purpose of releasing one or more reagents; however, this is not required. The size, shape, orientation and position of the one or more discharge ports are non-limiting. The top end of the lance can include a swivel member configured to couple a hose (e.g., flexible hose, rigid hose, pipe, etc.) to the passage extending through the lance. The size, shape, and type of swivel member used are non-limiting.

In another and/or alternative non-limiting aspect of the present invention, the support housing of the lance drive system can optionally include one or more components of the lance drive system to partially or fully protect such components from damage during the operation of the lance drive system; however, this is not required. The support housing can optionally include a removable cover member for the purpose of permitting access to the interior of the support housing; however, this is not required.

In yet another and/or alternative non-limiting aspect of the present invention, the lance mount arrangement of the lance drive system includes one or more mounting members. Generally, the one or more mounting members are configured to releaseably engage and secure the lance to the lance mount arrangement. In one non-limiting arrangement, the one or more mounting members are configured to be moveable such that the mounting member can be positioned to partially or fully encircle a portion of the lance to thereby releaseably secure the lance to the lance mount arrangement. In one non-limiting arrangement, the one or more mounting members are configured to engage non-circular cross-section portions of the lance; however, this is not required. The length, width, and thickness of the one or more mounting members are non-limiting. In one non-limiting configuration, the one or more mounting members include a slot or hole configured to receive a pivot pin so that the one or more mounting members can be pivotally connected to the lance mount arrangement; however, this is not required. In another and/or alternative non-limiting design, the one or more mounting members can be rigidly mounted to a lance mount arrangement; however, this is not required. In another and/or alternative non-limiting arrangement, two mounting members are used and a first mounting member is positioned above a second mounting member and spaced from one another; however, this is not required. In another and/or alternative non-limiting design, a support member can be connected to both mounting members and can be used to simultaneously move both mounting members between an open and closed position to facilitate in the connection and removal of the lance from the lance mount arrangement; however, this is not required. The support member (when used) can be configured to include a handle; however, this is not required. As can be appreciated, other or additional the types of locking mechanisms can be used to releasably secure the lance to the lance mount arrangement (e.g., latches, lock pins, clips, snaps, bolts, threaded fasteners, clamps, springs, buckles, etc.).

In another and/or alternative non-limiting aspect of the present invention, the present invention includes a drive motor assembly. As can be appreciated, the drive motor assembly can be located in the housing portion, or can be located external to the housing portion. The type of motor used is non-limiting. In one non-limiting design, an electric motor is used; however, this is not required. The lance drive system of the present invention can be configured to receive electrical power through a standard power cord connected to an AC power outlet, and a power switch that can be optionally provided externally on the housing portion for turning power to the lance drive system on and off; however, this is not required. The drive motor assembly of the present invention is configured to actuate rotation of the lance mount arrangement; however, this is not required. The actuating means is non-limiting. For example, the actuating means can include a gear drive, a worm gear drive, a bevel gear drive, a rack and pinion drive, a cable drive system, a pulley drive system, a chain drive system, etc. The actuating means can be intermittent (e.g., intermittent gears, linear gears, etc.), oscillating (e.g., oscillating gears), and/or continuous; however, this is not required. In one non-limiting design, the drive motor assembly includes a gear drive system. The gear drive system (when used) can comprise one or more gears. The one or more gears are used to cause the main rotary element to rotate when the drive motor is actuated.

In another and/or alternative non-limiting aspect of the present invention, the drive motor assembly is configured to cause the main rotary element to reciprocate; however, this is not required. In one non-limiting embodiment of the present invention, the drive motor assembly can include a torque detection arrangement for the purpose of detecting pressure applied to the main rotary element; however, this is not required. As such, if excessive torque is applied to a main rotary element, the drive motor can be deactivated so as to prevent the drive motor from burning out due to overuse, overheating, etc.; however, this is not required.

In yet another and/or alternative non-limiting aspect of the present invention, the lance drive system can be configured to operate in conjunction with a reagent injection system; however, this is not required. As such, the lance drive system can optionally include one or more flow detection sensors for the purpose of measuring and/or detecting the flow of reagent into the lance; however, this is not required. As such, the lance drive system can be configured to release reagent into the lance when the lance moves in a pre-set direction (e.g., clockwise direction, counterclockwise direction, etc.); however, this is not required. Similarly, the flow rate of reagent through the reagent injection system (when used) can be adjusted based on one or more factors (e.g., time, lance movement, lance position, etc.); however, this is not required.

In another and/or alternative non-limiting aspect of the present invention, the lance drive system includes a rotation detection system. The rotation detection system (when used) can be provided for the purpose of detecting: 1) rotational position of the main rotary element, the lance mount arrangement and/or the lance; 2) rotational direction of the main rotary element, the lance mount arrangement and/or the lance; 3) rotational speed of the main rotary element, the lance mount arrangement and/or the lance; and/or 4) number of rotations of the main rotary element, the lance mount arrangement and/or the lance. As can be appreciated, the rotation detection system can be configured to measure other and/or alternative operations of the lance drive system. The rotation detection system includes a sensor system. The sensor system (when used) is not limited in size, shape, or quantity. For example, the sensors can be optical sensors, magnetic sensors, tactile sensors, rotational sensors, mechanical sensors, ultrasonic sensors, etc. In one non-limiting arrangement, one or more optical sensors can be configured to detect surface structures, images, and/or gear teeth on the drive motor, the one or more gears, the main rotary element, the lance mount arrangement and/or the lance; however, this is not required. In another non-limiting arrangement, one or more magnetic sensors can be configured to detect one or more structures on the surface of the drive motor, the one or more gears, the main rotary element, the lance mount arrangement and/or the lance; however, this is not required. In another non-limiting arrangement, one or more tactile sensors can be configured to detect surface projections and/or gear teeth on the surface of the drive motor, the one or more gears, the main rotary element, the lance mount arrangement and/or the lance; however, this is not required. The one or more sensors can be configured to directly or indirectly 1) provide limits of rotation to the main rotary element, 2) count the number of rotations and/or reciprocations of the main rotary element, 3) cause the main rotary element to move to a particular location (e.g., lance mounting or dismounting position, etc.), 4) control the speed of rotation of the main rotary element, and/or 5) provide information regarding the proper functioning of the lance drive system; however this is not required. In one non-limiting configuration, the rotation detection system includes one or more magnetic sensors and one or more corresponding magnets or detection structures. The magnetic sensors can be provided on an interior and/or exterior surface of the support housing, and the one or more corresponding magnets or detection structures can be provided on the main rotary element; however, this is not required. As can be appreciated, other or alternative arrangements can be used. In such a configuration, the one or more magnetic sensors are capable of detecting the rotational position of the lance and the rotational direction of the lance as the lance rotates by detecting the position of the one or more magnets or detection structures on the main rotary element; however, this is not required. In another and/or alternative configuration, the rotation detection system includes one or more sensors provided on the support housing wherein the one or more sensors detect and/or count the teeth on the main rotary element as the main rotary element rotates; however, this is not required. In another and/or alternative non-limiting arrangement, the one or more sensors can be in communication with a motor control motor such that once a number of gear teeth on the main rotary element have been detected during rotation and/or a certain position of the main rotary element has been detected during rotation, the motor reverses direction, stops, increases speed and/or reduces speed; however, this is not required.

In another and/or alternative non-limiting aspect of the present invention, the rotation detection system causes the lance mount arrangement to rotate less than 360° in a given rotational direction; however, this is not required. In one non-limiting arrangement, the rotation detection system causes the main rotary element and/or lance mount arrangement to rotate about 1-359° (and all values and ranges therebetween) in a given rotational direction before the direction of rotation is stopped or reversed. In yet another non-limiting arrangement, the rotation detection system causes the main rotary element and/or lance mount arrangement to rotate about 50-300° degrees in a given rotational direction before the direction of rotation is stopped or reversed. In yet another non-limiting arrangement, the rotation detection system causes the main rotary element and/or lance mount arrangement to rotate about 50-200° degrees in a given rotational direction before the direction of rotation is stopped or reversed. In yet another non-limiting arrangement, the rotation detection system causes the main rotary element and/or lance mount arrangement to rotate about 80-160° degrees in a given rotational direction before the direction of rotation is stopped or reversed.

In still another and/or alternative non-limiting aspect of the present invention, the rotation detection system can be used to define a loading position of the lance drive system; however, this is not required.

In yet another and/or alternative non-limiting aspect of the present invention, the one or more sensors can be used to slow down or speed up the rotation of the main rotary element and/or lance mount arrangement; however, this is not required. In such an arrangement, as a limit of rotation for the main rotary element and/or lance mount arrangement is reached, the speed of the drive motor can be configured to slow down such that the rotation of the main rotary element decreases; however, this is not required. Similarly, once the limit of rotation is reached and the drive motor reverses direction, the one or more sensors can be used to increase the drive motor speed, thereby increasing the rate of rotation of the main rotary element; however, this is not required. Also, when the movement or rotation of the lance is to be terminated, the one or more sensors can be used to decrease the drive motor speed during the stopping of the rotation of the main rotary element and/or lance mount arrangement and/or the positioning of the main rotary element and/or lance mount arrangement in a certain position; however, this is not required.

In still yet another and/or alternative non-limiting aspect of the present invention, the lance drive system can optionally include one or more visual indicators to inform a user of 1) the rotational direction of the main rotary element and/or lance mount arrangement, 2) the rotational position of the main rotary element and/or lance mount arrangement, 3) the activity of the rotation direction system, 4) the flow rate of reagent through the lance, and/or 5) a malfunction of the lance drive system. The one or more visual indicators (when used) can be printed material, lighting (e.g., green light indicates on, red light indicates off, LED display, LCD display, etc.), and/or a tactile indicator, monitor or screen, etc. The one or more visual indicators can be located on any portion of the housing portion. As can be appreciated sound alarms can also or alternatively be used.

In one non-limiting embodiment of the present invention, the lance drive system comprises a main support housing, a lance mount arrangement, a drive motor assembly, and a rotation detection system. In one non-limiting design, the lance drive system has a vertical height of at least about 0.5 feet and generally no more than about 10 feet. In one non-limiting design, the lance drive system has a vertical height of about 1-8 feet. In another non-limiting design, the lance drive system has a vertical height of about 2-6 feet. The vertical height of the lance drive system is generally equal to or greater than the vertical height of the lance drive system; however, this is not required.

One non-limiting object of the present invention is the provision of a lance drive system that can be used during the injection of gas and/or reagents into molten metal, and methods for using the same.

Another and/or alternative non-limiting object of the present invention is the provision of a lance drive system configured to move or rotate a lance about a vertical axis while simultaneously discharging reagent through the lance.

Another and/or alternative non-limiting object of the present invention is the provision of a lance drive system that includes a main support housing, a drive motor assembly, a lance mount arrangement and a sensor arrangement. The drive motor assembly is configured to cause a main rotary element in the main support housing to rotate about a main rotation axis. A lance mount arrangement is connected or interconnected to the main rotary element and is caused to rotate when the main rotary element rotates. The lance mount arrangement is configured to connect a lance to the lance mounting arrangement. The sensor arrangement is configured to control the rotation movement of the main rotary element.

Another and/or alternative non-limiting object of the present invention is the provision of a lance drive system that is configured to cause the main rotary element to reciprocate such that the main rotary element rotates about the main rotation axis less than 360°.

Another and/or alternative non-limiting object of the present invention is the provision of a lance drive system wherein the lance mount arrangement is connected or interconnected to the main rotary element at a location that is off center from the main rotation axis such that when the main rotary element rotates about the main rotation axis, and the longitudinal axis of the lance mount arrangement is not aligned with the main rotation axis, the lance mount is caused to move in a circular or semi-circular path that is spaced from and about the main rotation axis.

Another and/or alternative non-limiting object of the present invention is the provision of a lance drive system wherein the lance mount arrangement is at least partially connected to, interconnected to and/or positioned on an outer perimeter of the main rotary element.

Another and/or alternative non-limiting object of the present invention is the provision of a lance drive system wherein the lance mount arrangement is connected or interconnected to the main rotary element at a location that is aligned with the main rotation axis such that when the main rotary element rotates, the lance mount arrangement is caused to rotate within the main rotation axis and the longitudinal axis of the lance mount arrangement is aligned with the main rotation axis.

Another and/or alternative non-limiting object of the present invention is the provision of a lance drive system wherein a swivel coupling can optionally be used that is configured to permit connection of a supply hose to the lance or other structure so as to allow relative rotation between the supply hose and the lance or other structure.

Another and/or alternative non-limiting object of the present invention is the provision of a lance drive system that is configured to cause the lance to reciprocate about a vertical axis and/or rotate in one direction about a vertical axis.

Another and/or alternative non-limiting object of the present invention is the provision of a lance drive system wherein a cross-sectional shape of the lance can be circular, oval, hexagonal, rectangular, square, etc.

Another and/or alternative non-limiting object of the present invention is the provision of a lance drive system wherein the support housing of the lance drive system includes one or more components of the lance drive system to partially or fully protect such components from damage during the operation of the lance drive system.

Another and/or alternative non-limiting object of the present invention is the provision of a lance drive system wherein the lance mount arrangement includes one or more mounting members configured to releaseably engage and secure the lance to the lance mount arrangement.

Another and/or alternative non-limiting object of the present invention is the provision of a lance drive system wherein the drive motor assembly can include a torque detection arrangement for the purpose of detecting pressure applied to the main rotary element.

Another and/or alternative non-limiting object of the present invention is the provision of a lance drive system including one or more flow detection sensors for the purpose of measuring and/or detecting the flow of reagent into the lance.

Another and/or alternative non-limiting object of the present invention is the provision of a lance drive system wherein the rotation detection system can be provided for the purpose of detecting: 1) rotational position of the main rotary element, the lance mounting arrangement and/or the lance, 2) rotational direction of the main rotary element, the lance mounting arrangement and/or the lance, 3) rotational speed of the main rotary element, the lance mounting arrangement and/or the lance, and/or 4) number of rotations of the main rotary element, the lance mounting arrangement and/or the lance.

Another and/or alternative non-limiting object of the present invention is the provision of a lance drive system wherein the rotational detection system includes a sensor system such as one or more optical sensors, magnetic sensors, tactile sensors, rotational sensors, mechanical sensors, ultrasonic sensors, etc.

Another and/or alternative non-limiting object of the present invention is the provision of a lance drive system wherein the one or more sensors of the rotational detection system can be configured to directly or indirectly 1) provide limits of rotation to the main rotary element, 2) count the number of rotations and/or reciprocations of the main rotary element, 3) cause the main rotary element to move to a particular location (e.g., lance mounting or dismounting position, etc.), 4) control the speed of rotation of the main rotary element, and/or 5) provide information regarding the proper functioning of the lance drive system; however this is not required.

Another and/or alternative non-limiting object of the present invention is the provision of a lance drive system wherein the one or more sensors of the rotational detection system can be in communication with a motor control motor such that once a number of gear teeth on the main rotary element have been detected during rotation and/or a certain position of the main rotary element has been detected during rotation, the motor reverses direction, stops, increases speed and/or reduces speed.

Another and/or alternative non-limiting object of the present invention is the provision of a lance drive system wherein the rotation detection system causes the main rotary element and/or lance mount arrangement to rotate about 1-359° in a given rotational direction before the direction of rotation is stopped or reversed.

Another and/or alternative non-limiting object of the present invention is the provision of a lance drive system wherein the rotation detection system can be used to define a loading position of the lance drive system.

Another and/or alternative non-limiting object of the present invention is the provision of a lance drive system wherein the one or more sensors of the rotation detection system can be used to slow down or speed up the rotation of the main rotary element and/or lance mount arrangement.

Another and/or alternative non-limiting object of the present invention is the provision of a lance drive system that includes one or more visual indicators to inform a user of: 1) the rotational direction of the lance; 2) the rotational position of the main rotary element and/or lance mount arrangement; 3) the activity of the rotation direction system; 4) the flow rate of reagent through the lance; and/or 5) a malfunction of the lance drive system.

These and other objects and advantages will become apparent from the following description taken together with the accompanying drawings.

BRIEF DESCRIPTION OF THE DRAWINGS

Reference may now be made to the drawings which illustrate various non-limiting embodiments that the invention may take in physical form and in certain parts and arrangement of parts wherein.

DETAILED DESCRIPTION OF THE NON-LIMITING EMBODIMENTS

Figure 1:
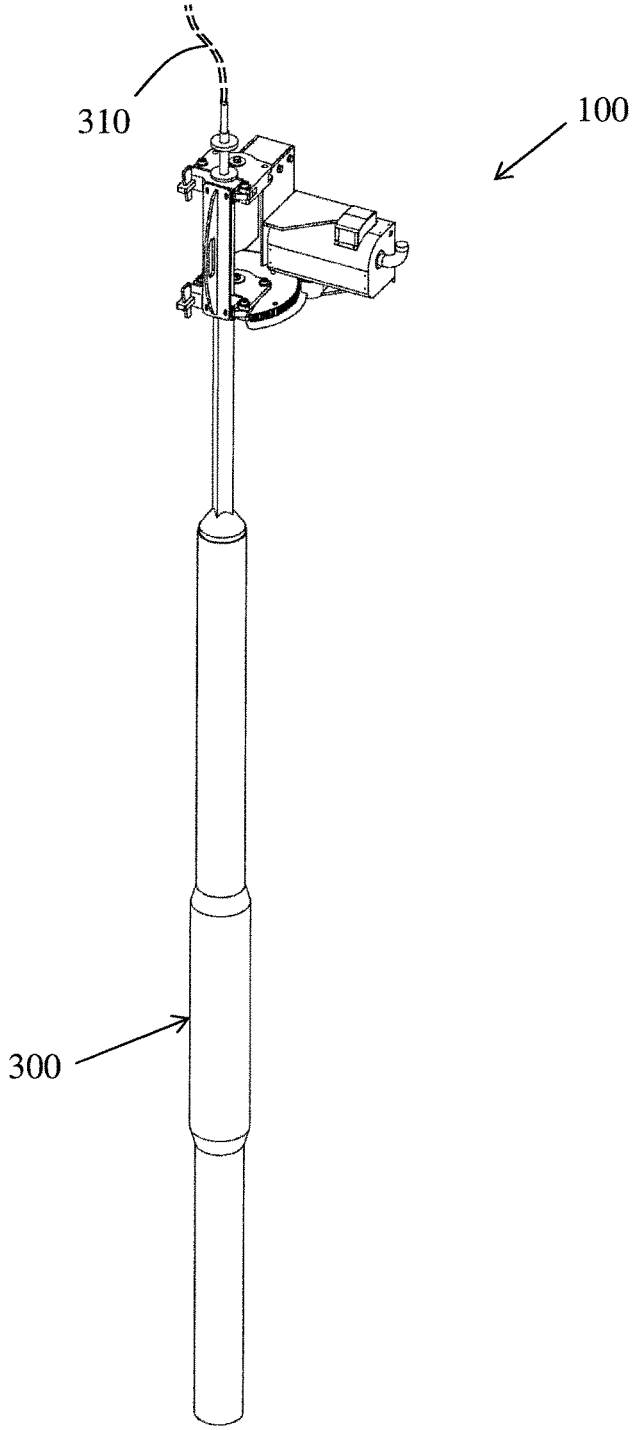
FIG. 1 illustrates a front elevation view of a non-limiting drive system assembly in accordance with the present invention.

Referring now to the drawings, wherein the showings are for the purpose of illustrating at least one non-limiting embodiment of the invention only and not for the purpose of limiting the invention, FIGS. 1-12 illustrate various non-limiting rotary drive systems in accordance with the present invention.

Referring now to FIGS. 1-6, there is illustrated a lance drive system 100 configured to move or rotate a lance 300 while the lance is dispensing material into molten metal during a metal treatment process. A hose 310 is illustrated as being connected to the top of the lance to provide one or more reagents to the lance. The hose is generally flexible and is connected to the top of the lance by a swivel connection; however, other types of connections can be used.

The lance drive system 100 comprises a main support housing 110, a lance mount arrangement 130, a drive motor assembly 170, and a rotation detection system 190.

Figure 2:
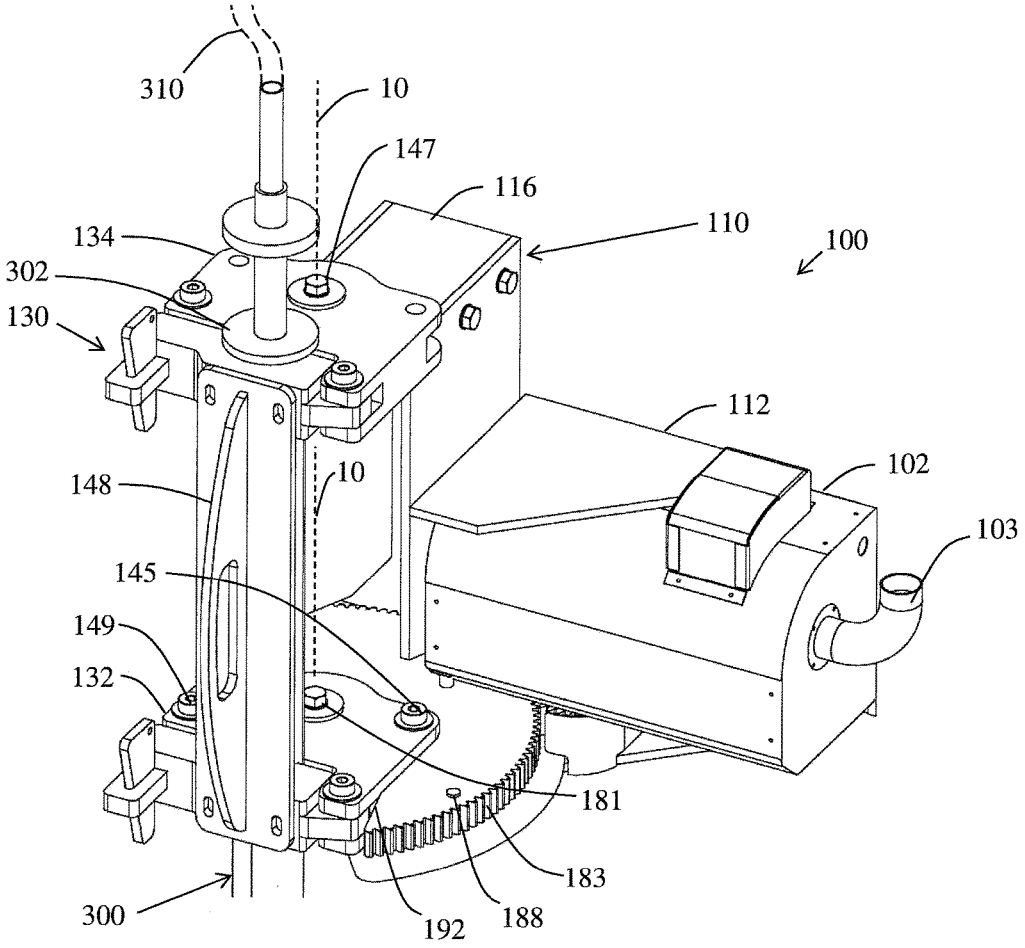
FIG. 2 is an enlarged view of the top portion of the drive system assembly of FIG. 1.

The main support housing 110 can include a first support housing portion 112 configured to house at least part of the drive motor assembly 170 and the rotation detection system 190, and a second support housing portion 114 configured to support at least a portion of the lance mounting arrangement 130; however, this is not required. As illustrated in FIG. 2, at least a portion of the first support housing portion 112 is divided off from the second support housing portion 114; however, this is not required. The first support housing portion 112 is configured to protect one or more components of the drive motor assembly and the rotation detection system 190 during the operation of the lance drive system. First support housing portion 112 can include a removable housing cover 102 to allow better access to the components at least partially contained in the first support housing portion. The first support housing portion optionally includes an air conduit 103 to provide for air flow into and/or out of the interior of the first support housing portion.

The main housing portion 110 is generally configured to be connected to an external structure (e.g., a post, a wall, a truck, etc.) so that the lance drive system can be secured in place during the operation of the lance drive system; however, this is not required.

Figure 3:
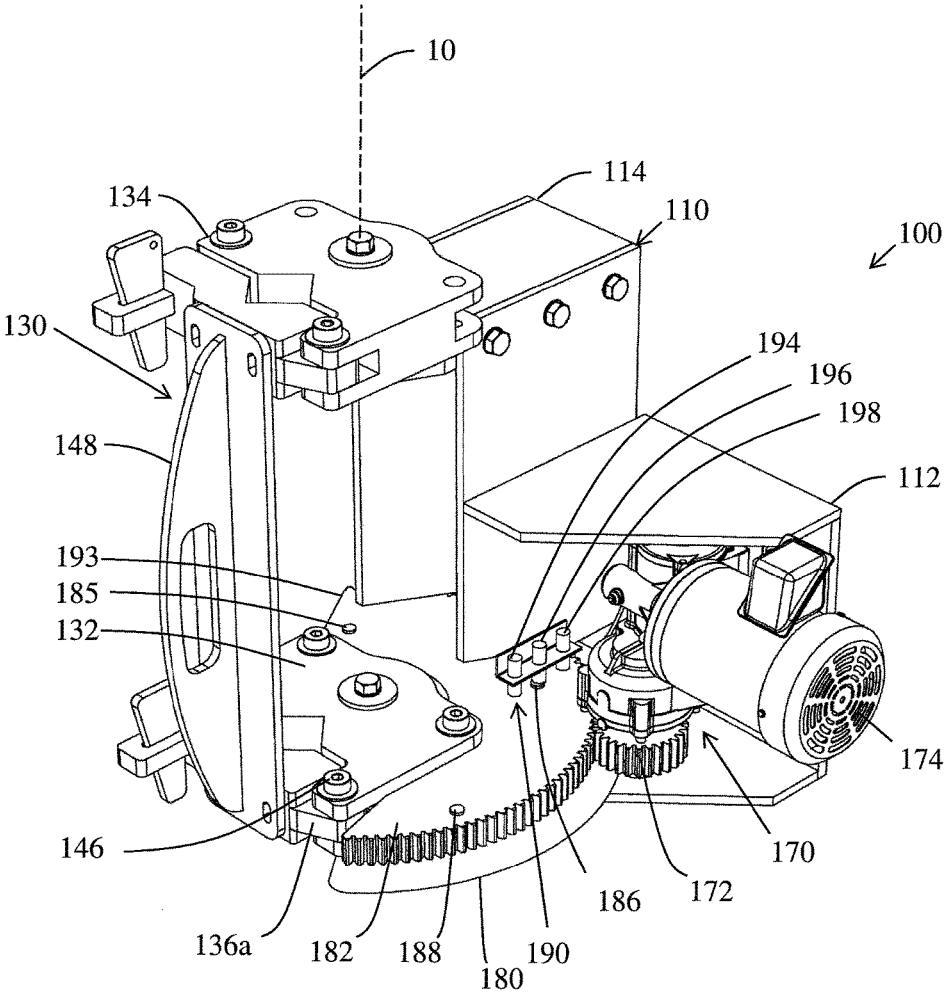
FIG. 3 is an enlarged view of the top portion of the drive system as illustrated in FIG. 2 wherein a portion of the main support housing is cut away to view portions of the drive motor assembly.

A main rotary element 180 is rotationally secured to main housing portion 110 and rotates about central rotary axis 10. A pin or bolt 181 can be used to secure the main rotary element to the main housing portion. A bushing and/or bearing may optionally be used to facilitate in the rotation of the main rotary element on the main housing portion. The outer peripheral surface of the main rotary element is illustrated as including a plurality of teeth 183. The teeth are configured to engage teeth on gear 172 of drive motor assembly 170 as illustrated in FIG. 3. Gear 172 is caused to be rotated by drive motor 174. A transmission arrangement can be used to rotatably connect the gear to the drive motor; however, this is not required. The transmission arrangement (when used) cab include one or more gears, belts, chains, hydraulics, etc. When the drive motor is activated, the gear 172 is caused to be rotated clockwise or counter clockwise. When gear 172 is caused to be rotated, the main rotary element is caused to be rotated. The direction of rotation of gear 172 results in the main rotary element either rotating in the clockwise or counterclockwise direction.

The main rotary element is illustrated as including teeth only on a portion of the peripheral surface of the main rotary element; however, this is not required. When such a teeth configuration is used, the main rotary element is thus configured to not rotate a full 360° about the central rotary axis 10. As will be described in more detail below, the main rotary element having such configuration is configured to reciprocate back and forth (i.e., repeatedly move in a clockwise rotation and then in a counterclockwise rotation) during the operation of the lance drive system.

The lance mount arrangement 130 is illustrated as being connected to both the main rotary element and a portion of the main housing portion. Referring now to FIGS. 2 and 3, a mount base member 132 of the lance mount arrangement is connected to the main rotary element by one or more bolts 145. Generally, the mount base member is connected to the top surface 182 of the main rotary element; however, this is not required.

Figure 4:
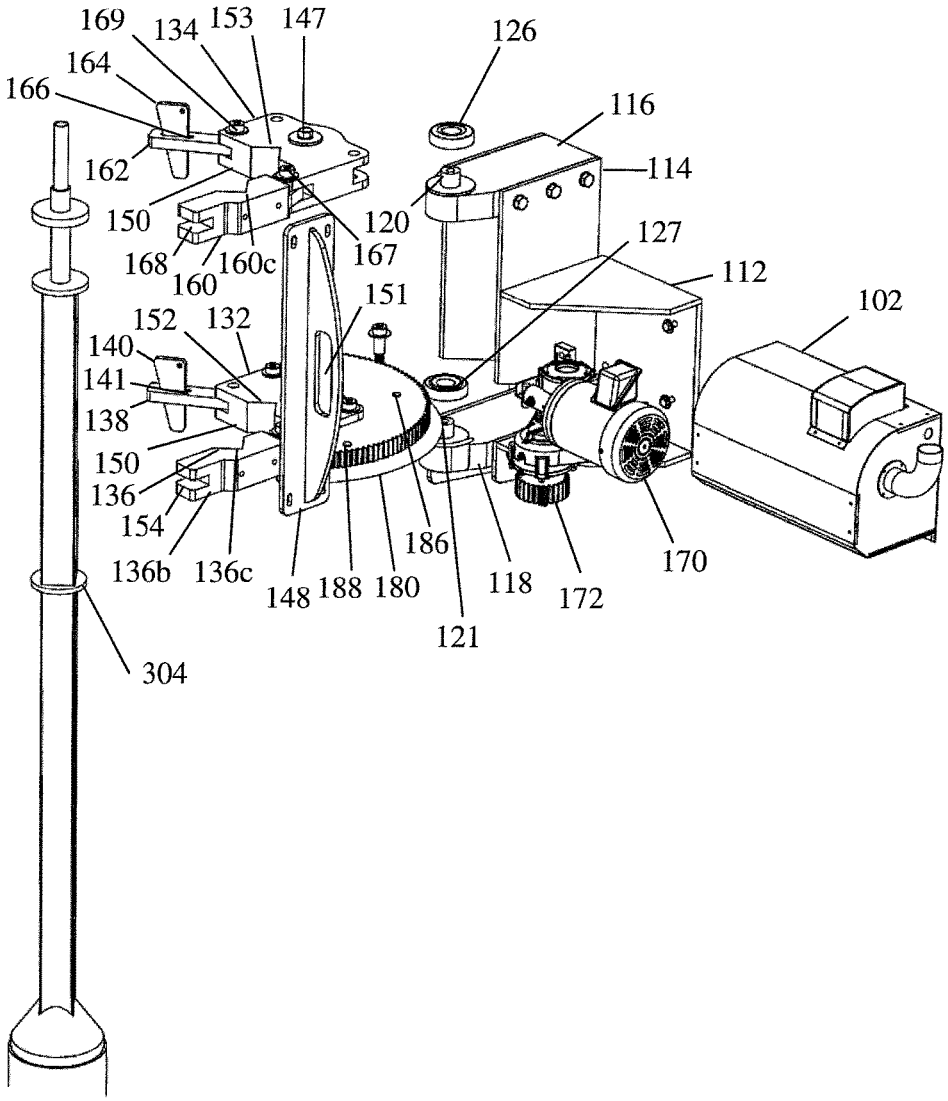
FIG. 4 is an exploded view of the drive system as illustrated in FIG. 1.
Figure 5:
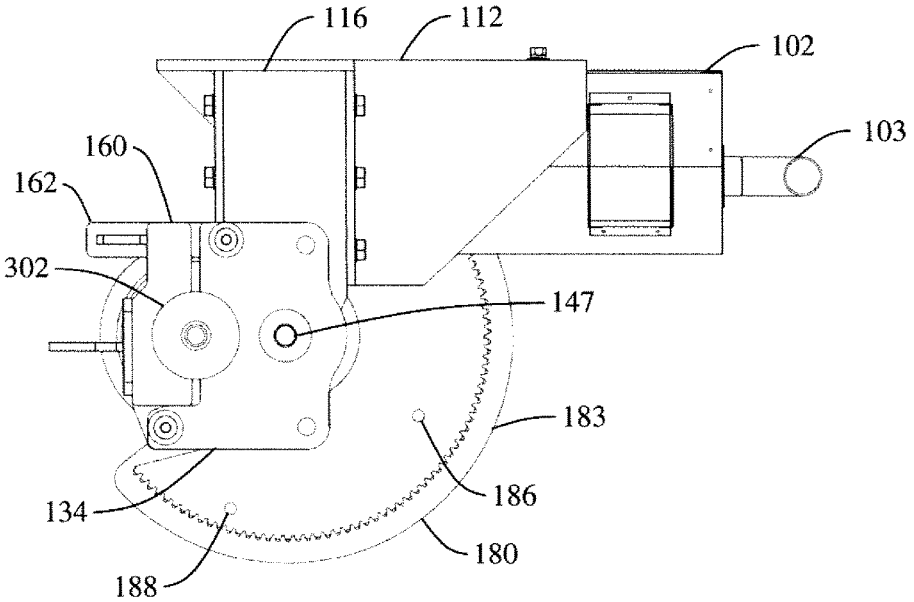
FIG. 5 is a top view of the drive system as illustrated in FIG. 1 illustrating the main rotary element in the maximum clockwise position.
Figure 6:
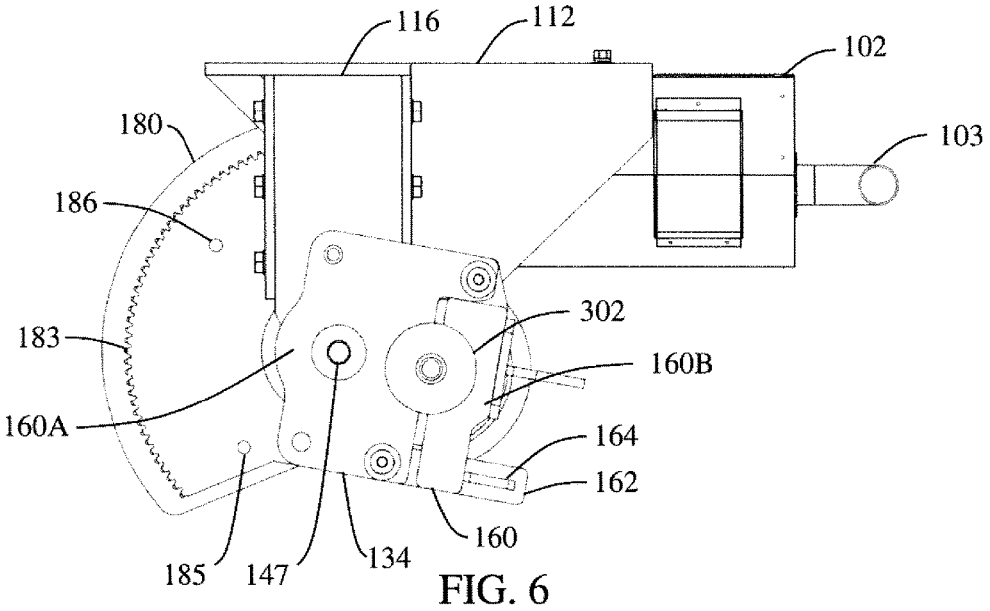
FIG. 6 is a top view of the drive system as illustrated in FIG. 1 illustrating the main rotary element in the maximum counterclockwise position.

A first end 136*a* of base gate member 136 is illustrated as being pivotally connected to mount base member via bolt or pin 146. As best illustrated in FIG. 4, the second end 136*b* of base gate member 136 includes a slot or recess 154. A first end of a base gate flange 138 is pivotally connected to mount base member via bolt or pin 149. The second end of base gate flange 138 includes a slot or opening 141 that is configured to receive a locking pin 140. Both the base gate member and the base gate flange are spaced from one another and are illustrated as being pivotally connected to the front portion of the mount base member. In operation, the base gate member 136 can be locked in the closed position by pivotally moving the base gate member 136 and the base gate flange 138 together until a portion of the base gate flange 138 moves into slot 154. Thereafter, locking pin 140 can be inserted into slot 141, thereby preventing the base gate flange from releasing from the base gate member and locking the base gate member in the closed and locked position as illustrated in FIGS. 2 and 3. When the base gate member is to be moved to the open position, the locking pin is removed from slot 141 and the base gate flange is removed from slot 154, thereby allowing the base gate member to be moved to an open and unlocked position.

As illustrated in FIGS. 3 and 4, the mount base member includes a mount slot 152 that is configured to receive at least a portion of lance 300 when the lance is releasably connected to the lance mount arrangement. Likewise, base gate member 136 includes a base mount slot 136*c* that is also configured to receive at least a portion of lance 300 when the lance is releasably connected to the lance mount arrangement. Both mount slot 152 and base mount slot 136*c* are illustrated as having a non-curved shape; however, this is not required. Specifically, both mount slot 152 and base mount slot 136*c* are illustrated as having a generally V-shape and together form a generally square or rectangular opening when the base gate member is in the closed position. As can be appreciated, other shapes of the opening can be formed when the base gate member is in the closed position. As can also be appreciated, mount base member or the base gate member can be absent a slot.

The mount top member 134 is pivotally connected to a top portion 116 of main support housing 110. A pin or bolt 147 is illustrated pivotally securing the mount top portion to the top portion of main support housing 110.

A first end 160A of top gate member 160 is illustrated as being pivotally connected to mount top member via bolt or pin 167. As best illustrated in FIG. 4, the second end 160B of top gate member 160 includes a slot or recess 168. A first end of top gate flange 162 is pivotally connected to mount top member 134 via bolt or pin 169. The second end of top gate flange 162 includes a slot or opening 166 that is configured to receive a locking pin 164. Both the top gate member and the top gate flange are spaced from one another and are illustrated as being pivotally connected to the front portion of the mount top member. In operation, the top gate member can be locked in the closed position by pivotally moving the top gate member and the base gate flange together until a portion of the base gate flange moves into slot 168. Thereafter, locking pin 164 can be inserted into slot 166, thereby preventing the top gate flange from releasing from the top gate member and locking the top gate member in the closed and locked position as illustrated in FIGS. 2 and 3. When the top gate member is to be moved to the open position, the locking pin is removed from slot 168 and the top gate flange is removed from slot 168, thereby allowing the top gate member to be moved to an open and unlocked position.

As illustrated in FIGS. 3 and 4, the mount top member includes a mount slot 153 that is configured to receive at least a portion of lance 300 when the lance is releasably connected to the lance mount arrangement. Likewise, top gate member 160 includes a top mount slot 160*c* that is also configured to receive at least a portion of lance 300 when the lance is releasably connected to the lance mount arrangement. Both mount slot 153 and top mount slot 160*c* are illustrated as having a non-curved shape; however, this is not required. Specifically, both mount slot 153 and top mount slot 160*c* are illustrated as having a generally V-shape and together form a generally square or rectangular opening when the base gate member is in the closed position. As can be appreciated, other shapes of the opening can be formed when the base gate member is in the closed position. As can also be appreciated, mount base member or the base gate member can be absent a slot. The mount slots on the top and bottom gate members can be located at or near a midpoint region of the mounting members; however, other or alternative arrangements may be used.

When the mount members are in the open position, a portion of the lance can be positioned up against mount slots 152, 153, after which the top and bottom gate members can be moved to the closed and locked position to releasably secure the lance to the lance mount arrangement. When the lance is to be removed from the lance mount arrangement, the top and bottom gate members are unlocked and moved to the open and unlocked position. The two openings that are formed by each mount slot 152, 153 and the respective top or bottom mount slot 136*c*, 160*c* when the gate members are in the closed position can have a shape that is the same or similar to the outer cross-sectional shape of the lance that is to be positioned in such openings; however, this is not required.

A mount support member 148 is optionally connected to both the base gate member 136 and the top gate member 160 of the lance mount arrangement. As such, the support member 148 provides structural support to both the base gate member and the top gate member and also enables the base gate member and the top gate member to be simultaneously moved between the open and closed positions. The mount support member can optionally include a handle opening 151 to facilitate in enabling a user to grasp and move the mount support member. In operation, the mount support member causes the mount top member to pivot about pivot pin 147 when the main rotary element 180 rotates.

As best illustrated in FIG. 4, the top surface of top portion 116 includes an upwardly extending pivot post 120 configured to engage with a pivot recess on the bottom surface of mount top member 134. Pin 147 passes through an opening in the top of the mount top member, optionally passes through an opening in bearing 126 and is secured in an opening in pivot post 120, thereby enabling mount top member to pivot relative to top portion 116. The top surface of bottom portion 118 of the main housing support 114 includes an upwardly extending pivot post 121 configured to engage with a pivot recess on the bottom surface of main rotary element 180. Pivot pin 181 passes through an opening in the top of main rotary element 180, optionally passes through an opening in bearing 127 and is secured in an opening in pivot post 121, thereby enabling main rotary element 180 to rotate about central rotary axis 10. The pivot posts can be generally cylindrical in shape and aligned along central rotary axis 10. The top surface of each pivot post can include a cutout and/or threaded hole for engagement with a respective pivot pin 124; however, the pivot pins can be connected in the main support housing by other means (e.g., bolt, weld bead, pin, etc.).

When the lance 300 is removably connected to the lance mount arrangement, the lance drive system 100 causes the lance to be reciprocally rotated about the central rotary axis 10. As illustrated in FIG. 2, when the lance is releasably mounted to the lance mounting arrangement, the central longitudinal axis of the lance is spaced from central rotary axis 10. As such, when the main rotary element rotates about central rotary axis 10, the lance is caused to move in a swiping arc motion. As such, the lance does not rotate about the central rotary axis 10, but instead moves about the central rotary axis 10 as the main rotary element is caused to rotate by the drive motor assembly.

The top portion of the lance can optionally include a top flange 302 and bottom flange 304. As illustrated in FIG. 2, the top flange is positioned above the gate top member when the gate top member is in the closed position. Such a flange position facilitates in preventing the flange from moving downwardly when the lance is releasably connected to the lance mount arrangement. Bottom flange 304 is configured to be positioned below the gate bottom member when the gate bottom member is in the closed position. Such a flange position facilitates in preventing the flange from moving upwardly when the lance is releasably connected to the lance mount arrangement. As can be appreciated, the flange can include a second top flange such that one top flange is positioned above and the other top flange is positioned below the gate top member when the gate top member is in the closed position. Such a flange position facilitates in preventing the flange from moving upwardly and downwardly when the lance is releasably connected to the lance mount arrangement.

Referring now to FIGS. 2-6, the lance drive system includes a non-limiting rotation detection system. The rotation detection system 190 includes a magnetic sensor system; however, other and/or alternative rotation detection systems can be used. The magnetic sensor system includes magnetic sensors 194, 196, 198 that are optionally mounted to an interior wall of support housing portion 112; however, this is not required. The magnetic sensor system also includes detection structures (e.g., magnets, material that is attracted to a magnet, etc.) 185, 186, 188 provided on the top surface 182 of main rotary element 180. The detection structures are illustrated as being spaced inwardly from the peripheral edge of the main rotary element and extend upwardly from top surface 182; however, this is not required. As illustrated in FIG. 3, each of the detection structures are spaced a different distance from the center of the main rotary element that is defined by the main rotary axis. Detection structure 188 is illustrated as being spaced at the greatest distance from the center of the main rotary element. Detection structure 185 is illustrated as being spaced at the closest distance from the center of the main rotary element. Detection structure 186 is illustrated as being spaced a greater distance from the center of the main rotary element than detection 185, but at a less distance from the center of the main rotary element than detection 188. As illustrated in FIG. 3, magnetic sensors 194, 196, 198 are positioned over the main rotary elements such that each magnetic sensor is configured to only detect one of the detection structures. In the orientation illustrated in FIG. 3, magnetic sensor 194 is positioned to only detect detection structure 185, magnetic sensor 196 is positioned to only detect detection structure 186, and magnetic sensor 198 is positioned to only detect detection structure 188. Generally, the magnetic sensors and the detection structures are positioned so that they do not contact one another as the main rotary element rotates; however, this is not required.

In use, the magnetic sensors 194, 196, 198 are configured to detect the position of the main rotary element, the speed of rotation of the main rotary element and/or the direction of rotation of main rotary element as one or more detection structures pass under and are detected by one or more of the magnetic sensors; however, this is not required. As illustrated in FIG. 3, detection structures 185, 188 are positioned at or near the two ends of the teeth located on the main rotary element. As such, detection structures 185, 188 of the rotation detection system define the limit of rotation of the main rotary element in the clockwise and the counterclockwise direction. As such, when detection structures 185, 188 are detected by one or more of the magnetic sensors, the rotation detection system can cause the drive motor of the drive motor assembly to stop and/or reverse direction so that the main rotary element does not rotate beyond a particular point; however, this is not required. Detection structure 186 can be used to cause the main rotary element to stop at a position that facilitates in the connecting or disconnecting of the lance from the lance mount arrangement; however, this is not required. Detection structure 186 can also or alternatively be used to detect the direction of rotation and/or speed of rotation of the main rotary element, and/or cause the rotational speed of the main rotary element to increase and/or decrease. For example, if the rotation detection system last detected detection structure 186 and then detects detection structure 185, the rotation detection system can optionally use this information to determine that the main rotary element is rotating in the clockwise direction. The elapsed time between the detection of detection structures 185 and 186 can also be optionally used to determine the speed of rotation of the main rotary element. Also, the detection of detection structure 186 can optionally be used to cause the main rotary element to reduce its rotation speed.

Figure 13:
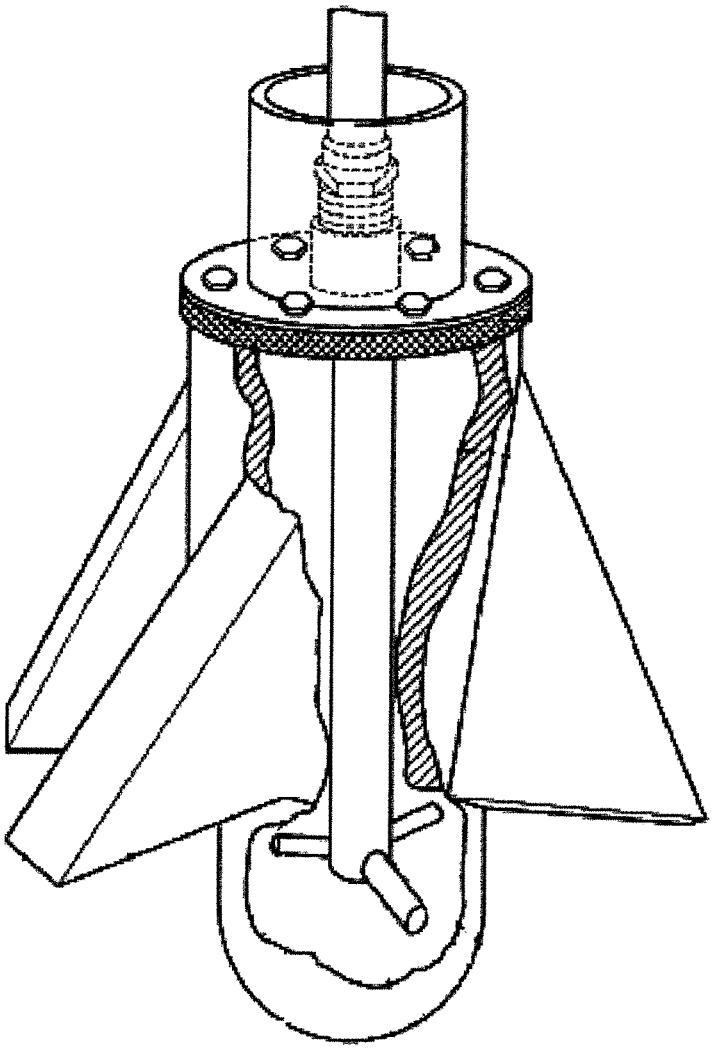
Figure 14:
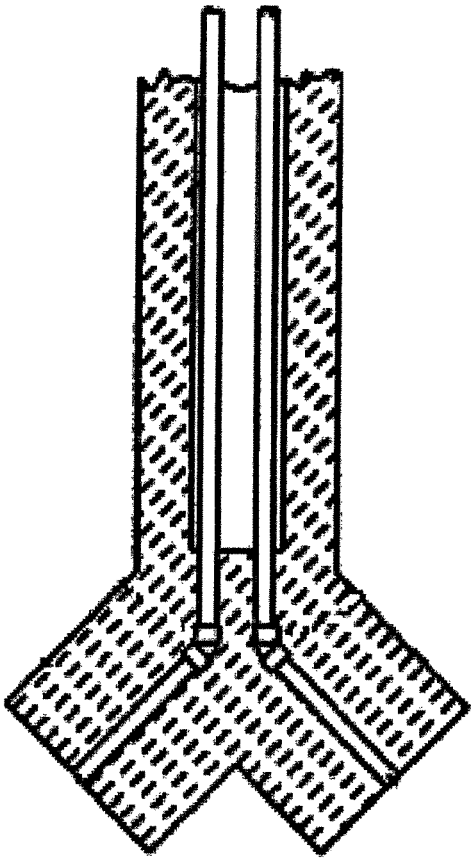

In use, a lance 300 is releasably secured to the lance drive system 100. A bottom end of lance 300 is inserted into the molten metal material and the lance is caused to move about the main rotary axis while the lance discharges one or more reagents into the molten metal. The bottom of the lance can include a single discharge opening configured to discharge material along the longitudinal axis of the lance, or can have one or more discharge opening as illustrated in FIGS. 13 and 14 that are configured to discharge material along an axis non-parallel to the longitudinal axis of the lance. The bottom portion of the lance can optionally include fins as illustrated in FIGS. 13 and 14 to facilitate in the mixing of the discharged material into the molten metal.

The movement of the lance can be controlled by the rotation detection system. When the drive motor 174 is actuated, main rotary element 180 is rotated in a clockwise or counterclockwise direction. As main rotary element 180 rotates, magnetic sensors 194, 196, 198 scan the top surface 182 of the main rotary element 180 to detect the detection structures on the main rotary element. As edge 193 of main rotary element 180 approaches magnetic sensors 194, 196, 198, magnetic sensor 194 detects detection structure 185 on the top surface of the main rotary element 180 and causes the drive motor to reverse in direction, thereby causing the rotational direction of the main rotary element to also reverse. As main rotary element 180 rotates counterclockwise, magnetic sensor 196 detects detection structure 186 on the top surface 182 of main rotary element 180. If the main rotary element is to stop at such location, the drive motor stops operation. If the main rotary element is to continue its counterclockwise rotation, the main rotary element will continue to rotate until edge 192 approaches magnetic sensors 194, 196, 198. When magnetic sensor 198 detects detection structure 188 on the top surface of the main rotary element 180, the drive motor is caused to reverse in direction, thereby causing the rotational direction of the main rotary element to also reverse. This detection process is repeated until further movement of the lance is no longer required. As such, lance 300 can be moved about main rotary axis 10 in a first rotational direction and then subsequently rotated about the main rotary axis in an opposite rotational direction. Generally, the degree of rotation of main rotary element 180 is chosen such that the main rotary element rotates less than 360° about the main rotary axis.

Referring now to FIGS. 7-12, there is illustrated another non-limiting lance drive system 200 configured to move or rotate a lance 400 while the lance is dispensing material into molten metal during a metal treatment process. A hose 410 is illustrated as being connected to the top of the lance to provide one or more reagents to the lance. The hose is generally flexible and is connected to the top of the lance by a swivel connection; however, other types of connections can be used.

The lance drive system 200 comprises a main support housing 210, a lance mount arrangement 220, a drive motor assembly 270, and a rotation detection system 290.

The main support housing 210 can be configured to house at least a portion of the drive motor assembly 270 and/or at least a portion of the lance mount arrangement 220; however, this is not required. The support housing 210 can include a removable housing cover 202 to allow better access to the components at least partially contained in the support housing. The drive motor assembly 270 optionally includes an air conduit 201 to provide air flow into and/or out of the interior of the support housing.

The main support housing 210 includes a top wall 212 and a bottom wall 211. Top wall 212 can include an opening 213 for the purpose of receiving a portion of the lance mount arrangement 220. Similarly, bottom wall 211 can include an opening 214 for the purpose of receiving a portion of the lance mount arrangement 220. The size and shape of openings 213, 214 are non-limiting. A bearing 216 is illustrated as being connected to the opening 213 in the top wall 212 of the main support housing and comprising a center opening 215. The bearing is configured to rotatably support the top portion of the lance mount arrangement to enable the top portion of the lance mount arrangement to rotate relative to the top wall; however, other types of connections can be used. Pin or bolt 217 can be used to secure a bearing plate 219 to the top wall of the housing. The bearing plate is used to secure bearing 216 in position relative to the top wall of the housing; however, this is not required.

Figure 10:
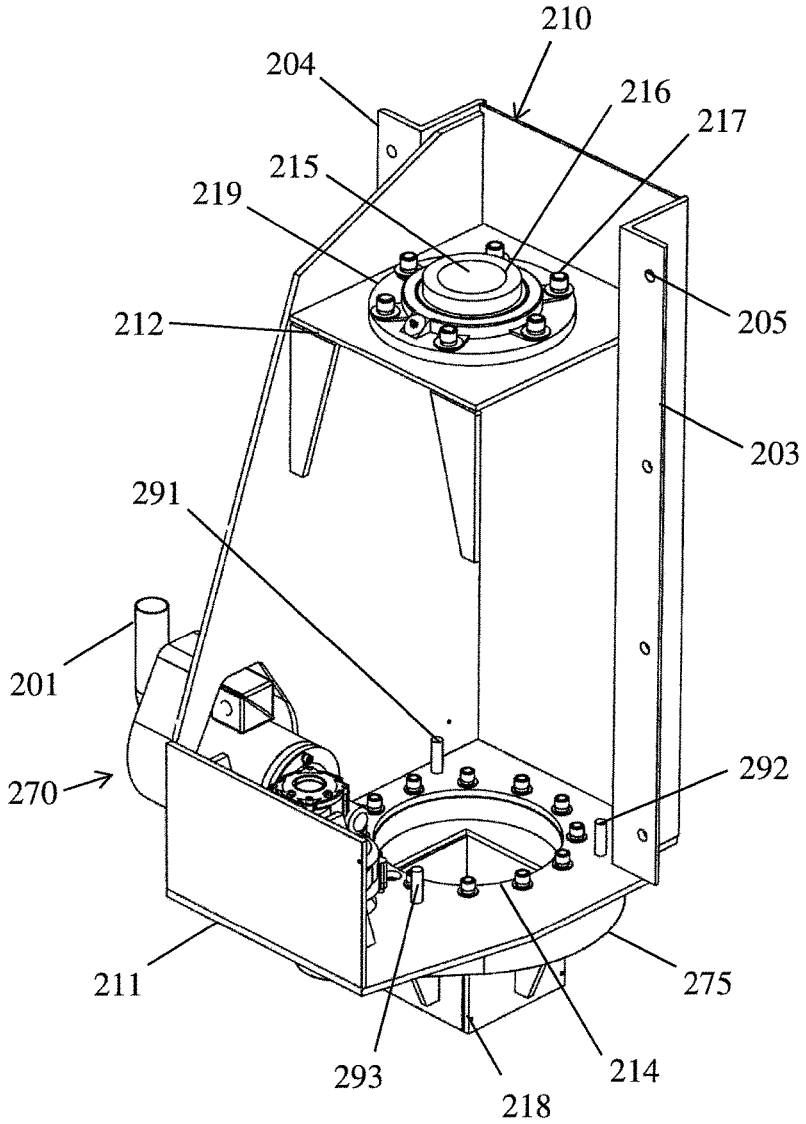
FIG. 10 is an enlarged view of the top portion of the drive system as illustrated in FIG. 7 wherein another portion of the main support housing is cut away.

Referring now to FIG. 10, the main support housing 210 includes a first bracket 203 and a second bracket 204 that are configured to connect the main support housing 210 to an external structure (e.g., a post, a wall, a truck, etc.) so that the lance drive system can be secured in place during operation of the lance drive system; however, this is not required. Brackets 203, 204 can include a plurality of slots or recesses 205; however, this is not required. A pin or bolt 206 can be used to secure brackets 203, 204 of main housing portion 210 to the external structure; however, other types of connections can be used (e.g., welding, rivets, etc.).

A main rotary element 272 is rotationally secured to the main housing portion 210 and rotates about central rotary axis 20. The main rotary element is configured such that a radially inward portion 278 remains fixed to the bottom wall of the main support housing while the radially outward portion 277 rotates about the radially inward portion and about central rotary axis 20; however, this is not required. The top surface of the radially inward portion 278 can include a plurality of slots of recesses. One or more pins or bolts 271 can be used to secure the radially inward portion 278 of the main rotary element to the bottom surface of the bottom wall 211 of the main support housing. Bushings and/or bearings may optionally be used to facilitate in the rotation of the main rotary element on the main support housing; however, this is not required.

Figure 9:
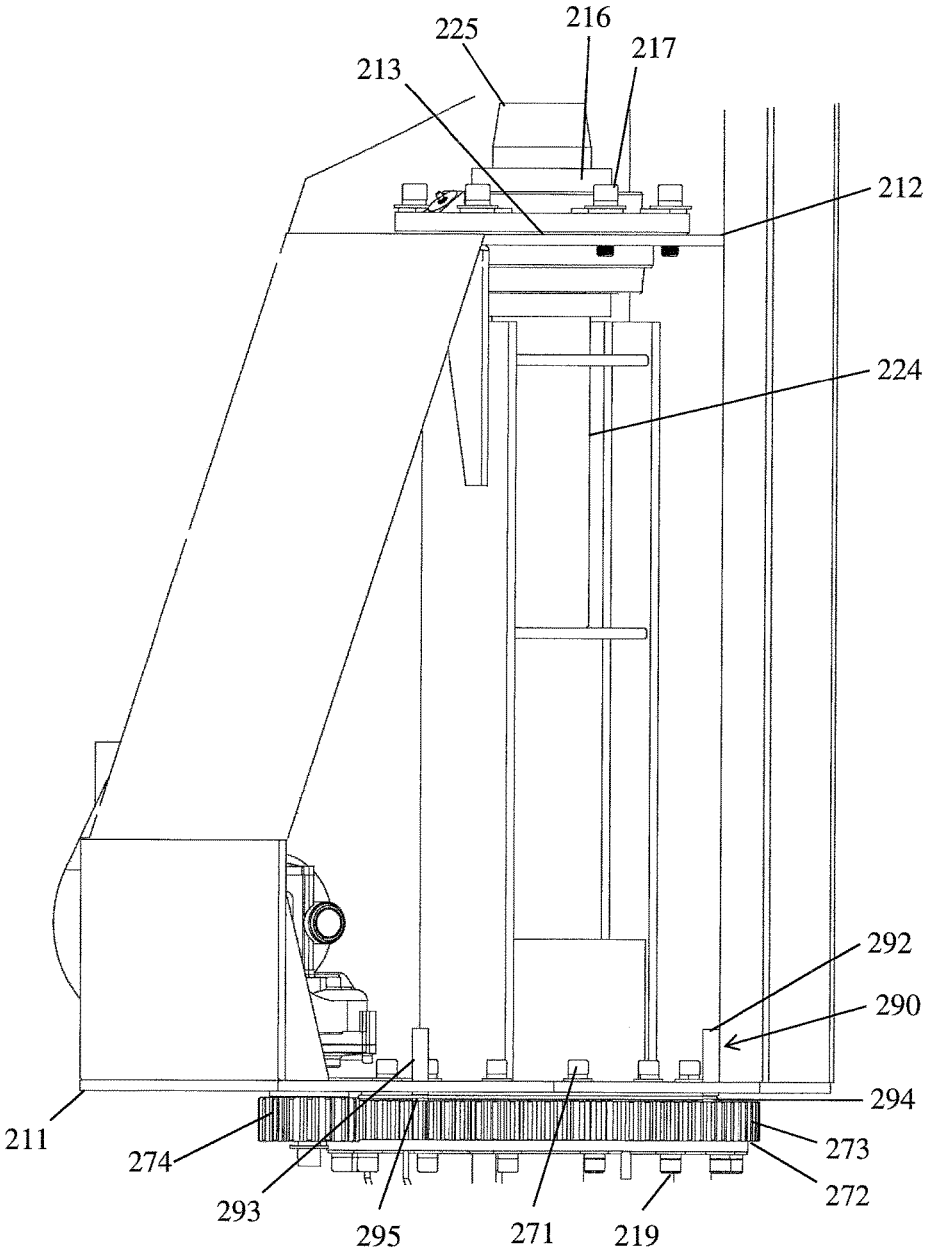
FIG. 9 is a side plan view of the top portion of the drive system as illustrated in FIG. 8.

The outer peripheral surface of the main rotary element is illustrated as including a plurality of teeth 273. The teeth are configured to engage teeth on gear 274 of drive motor assembly 270 as illustrated in FIG. 9. Gear 274 is caused to be rotated by drive motor 276. A transmission arrangement can be used to rotatably connect the gear to the drive motor; however, this is not required. The transmission arrangement (when used) can include one or more gears, belts, chains, hydraulics, etc. When the drive motor is activated, gear 274 is caused to be rotated clockwise or counterclockwise. When gear 274 is caused to be rotated, the main rotary element is caused to be rotated. The direction of rotation of gear 274 will result in the main rotary element either being rotated in the clockwise or counterclockwise direction.

The main rotary element is illustrated in FIGS. 7-12 as including teeth around the entire peripheral surface of the main rotary element; however, this is not required. When such a teeth configuration is used, the main rotary element is thus configured to optionally rotate a full 360° about the central rotary axis 20. As will be described in more detail below, the main rotary element having such configuration is configured to rotate continuously in one direction; however, this is not required. As can be appreciated, the main rotary element can optionally be configured to reciprocate back and forth (i.e., repeatedly move in a clockwise rotation and then in a counterclockwise rotation) greater than or less than 360° during the operation of the lance drive system.

As illustrated in FIGS. 7-12, a gear cover 275 is optionally provided to protect one or more components of the drive motor assembly and the rotation detection system components during the operation of the lance drive system.

The lance mount arrangement 220 is illustrated as comprising a main support beam 222, a mount base member 252, and a mount top member 232.

A top end of the lance mount arrangement 220 is illustrated as being connected to both the main housing and the main rotary element. The top end portion of the lance mount arrangement is rotatably connected to the main support housing. The portion of the lance mount arrangement that is positioned at or near the main rotary element is connected to interconnected to the main rotary element so that when the main rotary element rotates, the lance mount arrangement is also cause to rotate.

The main support beam 222 can optionally include one or more structural support elements 226; however, this is not required. A top end of the main support beam 222 of the lance mount arrangement 220 is illustrated as comprising a tubular extension 224. The top of the tubular extension can optionally include a tapered portion 225. Extension 224 is configured to be inserted through opening 213 in the top wall 212 of the main support housing and optionally through opening 215 of bearing 216, thereby enabling stable rotation of the main support beam about the central rotary axis 20. The extension 224 can be generally circular in cross-sectional shape so as to correspond with the circular opening 215 in bearing 216; however, other cross-sectional shapes can be used.

Referring now to FIGS. 7-12, a coupling member 218 is connected to the bottom surface of the radially outward portion 277 of the main rotary element by one or more bolts 219; however, the coupling member can be connected to the main rotary element by other means (e.g., weld, pin, etc.). As such, when radially outward portion 277 of the main rotary element rotates in a clockwise or counterclockwise direction, the coupling member 218 is also caused to rotate in the clockwise or counterclockwise direction. A portion of the main support beam of the lance mount arrangement can be connected to coupling member 218; however, this is not required. Such connection can be by bolts, screws, rivets, weld bead, clamp, etc.

Referring now to FIGS. 7-12, a mount base member 252 of the lance mount arrangement is optionally rigidly connected to mount support plate 229 of the lance mount arrangement. As can be appreciated, mount base member 252 can be directly connected to the main support beam of the lance mount arrangement. Generally, the mount base member is connected to the front surface 223 of the main support beam 222; however, this is not required.

Figure 7:
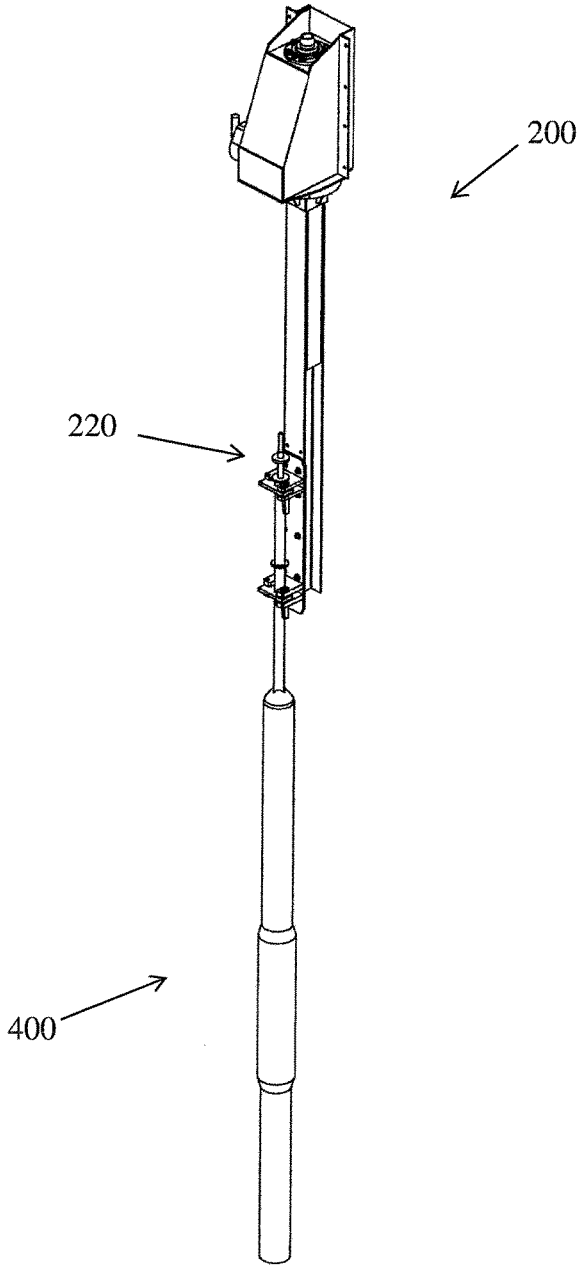
FIG. 7 illustrates a front elevation view of another non-limiting drive system assembly in accordance with the present invention.
Figure 8:
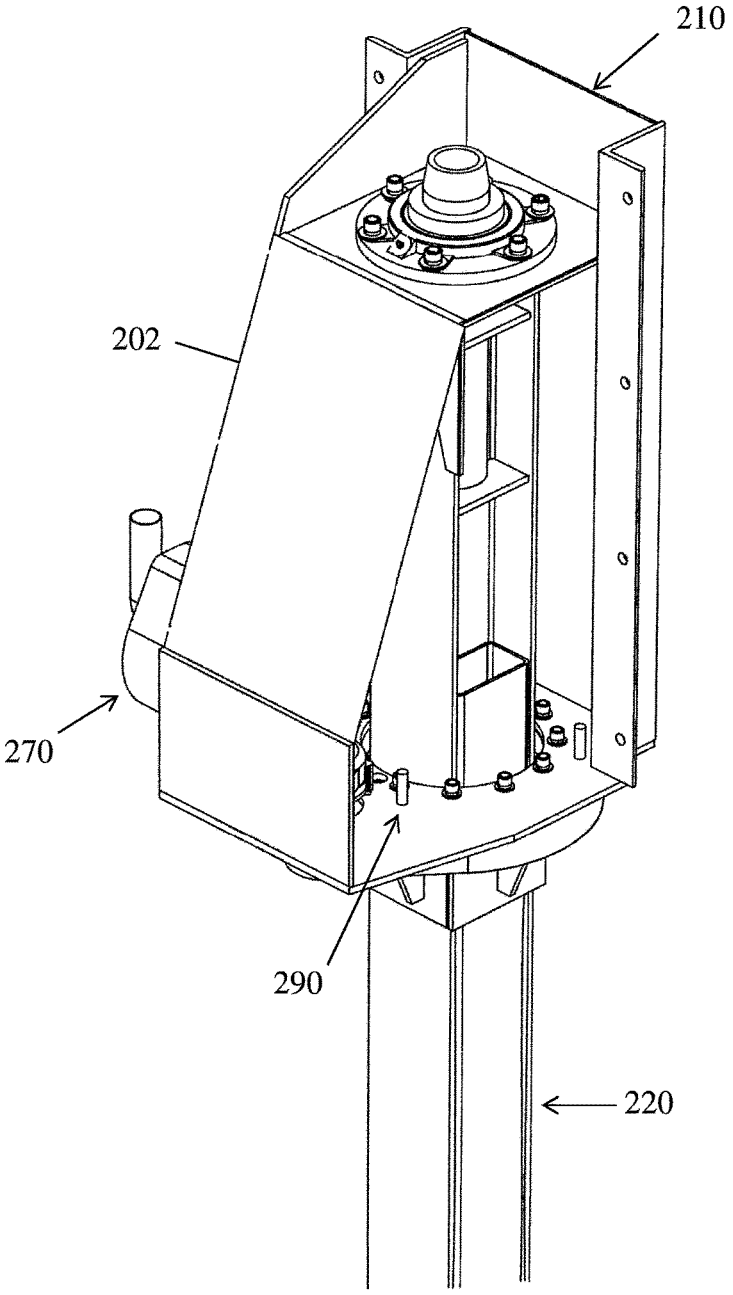
FIG. 8 is an enlarged view of the top portion of the drive system as illustrated in FIG. 7 wherein one portion of the main support housing is cut away.
Figure 12:
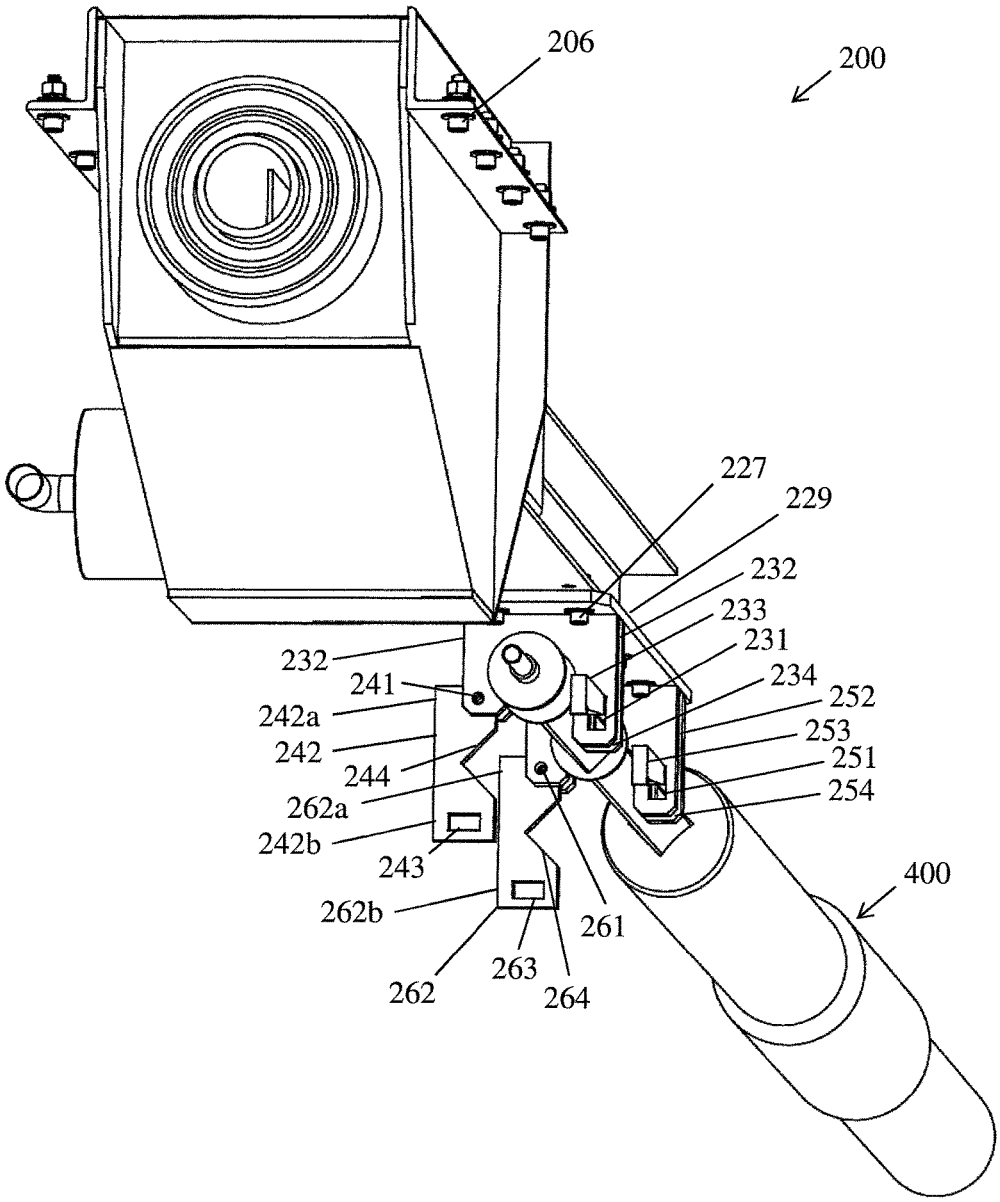
FIG. 12 is a top view of the drive system as illustrated in FIG. 7 illustrating the lance being connected to the lance mount arrangement; and, FIGS. 13 and 14 illustrate two non-limiting lance configurations for the bottom portion of a lance.

As best illustrated in FIG. 12, a first end 262*a* of base gate member 262 is pivotally connected to mount base member 252 via bolt or pin 261. The second end 262*b* of base gate member 262 includes a slot or recess 263 that is configured to receive a locking pin 253. In operation, the base gate member 262 can be locked in the closed position by pivotally moving the base gate member 262 and the mount base member 252 together until a portion of the base gate member 262 moves into slot or recess 254 of base mount member 252. Thereafter, slot 263 of the base gate member and slot 251 of the base mount member at least partially align and a locking pin 253 can be inserted into slots 263, 251, thereby preventing the base gate member from releasing from the base mount member and locking the base gate member in the closed and locked position as illustrated in FIGS. 7 and 12. When the base gate member is to be moved to the open position, the locking pin is removed from slots 263, 251 and the base gate member is removed from slot or recess 254, thereby allowing the base gate member to be moved and/or pivoted to an open and unlocked position.

Figure 11:
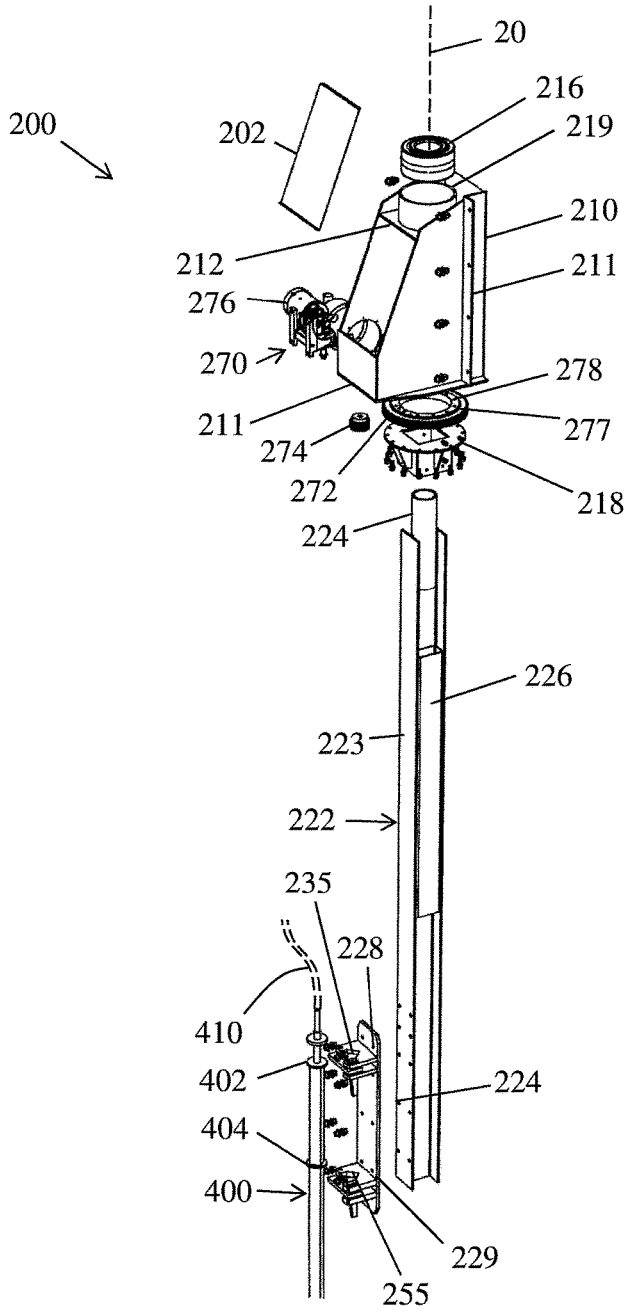
FIG. 11 is an exploded view of the drive system as illustrated in FIG. 7.

As best illustrated in FIGS. 11 and 12, the mount base member includes a mount slot 255 that is configured to receive at least a portion of lance 400 when the lance is releasably connected to the lance arrangement. Likewise, the base gate member 262 includes a mount slot 264 that is also configured to receive at least a portion of the lance 400 when the lance is releasably connected to the lance mount arrangement. Both mount slot 255 and gate mount slot 264 are illustrated as having a non-curved shape; however, this is not required. Specifically, both mount slot 255 and gate mount slot 264 are illustrated as having a generally V-shape and together they form a generally square or rectangular opening when the base gate member is in the closed position. As can be appreciated, other shapes of the opening can be formed when the base gate member is in the closed position. As can also be appreciated, the mount base member or the base gate member can be absent a slot.

The mount top member 232 is optionally rigidly connected to mount support plate 229 of the lance mount arrangement. As illustrated in FIGS. 7-12, mount top member 232 is positioned above mount base member 252 on the front surface 223 of the main support beam; however, other configurations may be used.

As best illustrated in FIG. 12, a first end 242*a* of top gate member 242 is pivotally connected to the mount top member via bolt or pin 241. The second end 242*b* of top gate member 242 includes a slot or recess 243 that is configured to receive a locking pin 233. In operation, the top gate member 242 can be locked in the closed position by pivotally moving the top gate member 242 and the mount top member 232 together until a portion of the top gate member 242 moves into slot 234 of top mount member 232. Thereafter, slot 243 of the top gate member and 231 of the top mount member at least partially align and a locking pin 233 can be inserted into slots 243, 231, thereby preventing the top gate member from releasing from the top mount member and locking the top gate member in the closed and locked position as illustrated in FIGS. 7 and 12. When the top gate member is to be moved to the open position, the locking pin is removed from slots 243, 231 and the top gate member is removed from slot 234, thereby allowing the top gate member to be moved and/or pivoted to an open and unlocked position.

As illustrated in FIGS. 11 and 12, the top mount member includes a mount slot 235 that is configured to receive at least a portion of lance 400 when the lance is releasably connected to the lance arrangement. Likewise, the top gate member 242 includes a mount slot 244 that is also configured to receive at least a portion of lance 400 when the lance is releasably connected to the lance mount arrangement. Both mount slot 235 and mount slot 244 are illustrated as having a non-curved shape; however, this is not required. Specifically, both mount slot 235 and gate mount slot 244 are illustrated as having a generally V-shape and together form a generally square or rectangular opening when the top gate member is in the closed position. As can be appreciated, other shapes of the opening can be formed when the top gate member is in the closed position. As can also be appreciated, the mount top member or the top gate member can be absent a slot. The mount slots on the top and bottom gate members can be located at or near a midpoint region of the mounting members; however, other or alternative arrangements may be used.

When the gate members are in the open position, a portion of the lance can be positioned up against mount slots 235, 255; thereafter, the top and bottom gate members can be moved to the closed and locked position to releasably secure the lance to the lance mount arrangement. When the lance is to be removed from the lance mount arrangement, the top and bottom gate members are unlocked and moved to the open and unlocked position. The two openings that are formed by each mount slot 235, 255 and the respective top and bottom gate mount slots 244, 264 when the gate members are in the closed position can have a shape that is the same or similar to the outer cross-sectional shape of the lance that is to be positioned in such openings; however, this is not required.

Mount base member 252 and mount top member 232 are optionally connected at a back surface to a mounting plate 229. The mounting plate 229 provides structural support to both the mount base member and the mount top member and also enables vertical and/or horizontal adjustment of the support members on the front surface of the main support beam; however, this is not required. As can be appreciated, the mount base member and the mount top member can be connected directly to the main support beam 222.

As best seen in FIGS. 11 and 12, the mounting plate 229 is configured to engage with a bottom portion of the main support beam 222. Mounting plate 229 includes a plurality of slots or openings 228. The front surface 223 of the bottom portion of main support beam 222 optionally includes a plurality of slots or openings 224; however, this is not required. Bolt or pin 227 passes through a slot or opening 228 in the mounting plate and is optionally secured in a slot or opening 224 in main support beam 222.

When the lance 400 is removably connected to the lance mount arrangement, the lance drive system 200 causes the lance to be fully move about or reciprocally move about the central rotary axis 20. As illustrated in FIGS. 7-12, when the lance is releasably mounted to the lance mounting arrangement, the central longitudinal axis of the lance is spaced from the central rotary axis 20. As such, when the main rotary element rotates about central rotary axis 20, the lance is caused to move in a sweeping arc motion. As such, the lance does not rotate about the central rotary axis 10, but instead moves about the central rotary axis 20 as the main rotary element is caused to rotate by the drive motor assembly.

The top portion of the lance can optionally include a top flange 402 and a bottom flange 404. As best illustrated in FIGS. 7-12, the top flange is positioned above the gate top member when the gate top member is in the closed position. Such a flange position facilitates in preventing the flange from moving downwardly when the lance is releasably connected to the lance mount arrangement. Bottom flange 404 is configured to be positioned below the gate bottom member when the gate bottom member is in the closed position. Such a flange position facilitates in preventing the flange from moving upwardly when the lance is releasably connected to the lance mount arrangement. As can be appreciated, the flange can include a second top flange such that the one top flange is positioned above and the other top flange is positioned below gate top member when the gate top member is in the closed position. Such a flange position facilitates in preventing the flange from moving upwardly and downwardly when the lance is releasably connected to the lance mount arrangement.

Referring now to FIGS. 7-12, a non-limiting rotation detection system is illustrated. The rotation detection system 290 includes a magnetic sensor system; however, other and/or alternative rotation detection systems can be used. The magnetic sensor system includes one or more magnetic sensors 291, 292, 293 that are optionally mounted to the bottom wall 211 of the main support housing 210; however, this is not required. The magnetic sensor system also includes one or more detection structures 294, 295 (e.g., magnets, material that is attracted to a magnet, etc.), provided on the top surface of the main rotary element 272 as illustrated in FIG. 9. The detection structures are illustrated as being spaced inwardly from the peripheral edge of the main rotary element and extend upwardly from the top surface of the main rotary element; however, this is not required. Generally, the magnetic sensors and the detection structures are positioned so that they do not contact one another as the main rotary element rotates; however, this is not required. As illustrated in FIGS. 7-12, each of the detection structures are spaced a different distance from the center of the main rotary element that is defined by the main rotary axis; however, this is not required. Detection structures 294, 295 are illustrated as being provided on the radially outward portion 277. As illustrated in FIGS. 7-12, magnetic sensors 291, 292, 293 are positioned over radially outward portion 277 of the main rotary element such that each magnetic sensor is configured to detect one or more of the detection structures; however, this is not required. Generally, magnetic sensors 291, 292, 293 are each spaced a different distance from the main rotary axis; however, this is not required.

In use, the magnetic sensors 291, 292, 293 are configured to detect the position of the main rotary element, the speed of rotation of the main rotary element and/or the direction of rotation of main rotary element as one or more detection structures pass under and are detected by one or more of the magnetic sensors; however, this is not required. Because the main rotary element is capable of rotating 360° in a clockwise and counterclockwise direction, when the one or more detection structures are detected by one or more of the magnetic sensors, the detection structures can be used to: 1) define a limit of rotation of the main rotary element in the clockwise and the counter clockwise direction, 2) cause the main rotary element to stop at a position that facilitates in the connection or disconnection of the lance from the lance mount arrangement, 3) detect the direction of rotation of the main rotary element, 4) detect the speed of rotation of the main rotary element, and/or 5) cause the rotational speed of the main rotary element to increase or decrease.

In use, a lance 400 is releasably secured to the lance drive system 200. A bottom end of lance 400 is inserted into the molten metal material and the lance is caused to move about the main rotary axis while the lance discharges one or more reagents into the molten metal. The bottom of the lance can include a single discharge opening configured to discharge material along the longitudinal axis of the lance, or can have one or more discharge openings as illustrated in FIGS. 13 and 14 that are configured to discharge material along an axis non-parallel to the longitudinal axis of the lance. The bottom portion of the lance can optionally include fins as illustrated in FIGS. 13 and 14 to facilitate in the mixing of the discharged material into the molten metal.

The movement of the lance can be controlled by the rotation detection system. When the drive motor 276 is actuated, main rotary element 272 is rotated in a clockwise or counterclockwise direction. As main rotary element 272 rotates, magnetic sensors 291, 292, 293 scan the top surface of the radially outward portion 277 of the main rotary element 272 to detect the detection structures on the main rotary element. As detection structure 295 approaches magnetic sensor 293, magnetic sensor 293 detects detection structure 295 on the top surface of the main rotary element 272. Such detection can be used to causes the drive motor to reverse in direction, thereby causing the rotational direction of the main rotary element to also reverse if reciprocation of the lance is desired. Alternatively or additionally, such detection can be used to verify proper rotation speed of the main rotary element, proper operation of the lance drive arrangement, number of times detection structure detected, speed of rotation of the main rotary element, etc. If the main rotary element is to continue rotation in the same direction, the detection of the detection structure will not cause the drive motor to reverse.

As main rotary element 272 rotates, magnetic sensor 292 detects detection structure 294 or some other detection structure on the top surface of main rotary element 272. If the main rotary element is to stop at such location, the drive motor stops orientation. If the main rotary element is to continue, the main rotary element will to continue to rotate. In one non-limiting configuration, when magnetic sensor 292 detects detection structure 294 or some other detection structure on the top surface of the main rotary element 272, the drive motor is caused to reverse in direction, thereby causing the rotational direction of the main rotary element to also reverse; however, this is not required.

This detection process can be repeated until further movement of the lance is no longer required. This detection arrangement can thus be used for either continuous rotation of the main rotary element in a single direction or reciprocating motion of the main rotary element. As such, lance 400 can be moved about main rotary axis 20 in a first rotational direction and then subsequently rotated about the main rotary axis in an opposite rotational direction. Generally, the degree of rotation of main rotary element 272 is chosen such that the main rotary element rotates less than 360° about the main rotary axis when the main rotary drive is to be reciprocated; however, this is not required. As can be appreciated, the degree of reciprocation rotation of main rotary element 272 can be chosen such that the main rotary element rotates equal to or greater than 360° about the main rotary axis.

It will thus be seen that the objects set forth above, among those made apparent from the preceding description, are efficiently attained, and since certain changes may be made I the constructions set forth without departing from the spirit and scope of the invention, it is intended that all matter contained in the above description and shown in the accompanying drawing shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A lance drive system for moving an injection lance, said lance drive system comprising:

a main support housing;

a main rotary element rotatably secured to said main support housing and configured to rotate about a main rotary axis;

a lance mount arrangement, said lance mount arrangement connected to said main rotary element and to said main support housing, said lance mount arrangement configured to releasably connect to a lance, said lance having a lance longitudinal axis;

a drive motor assembly, said drive motor assembly including a drive motor, said drive motor configured to cause said main rotary element to rotate at least partially about said main rotary axis; and, a rotation detection arrangement, said rotation detection arrangement configured to detect or determine a rotational position, a rotational direction, a rotation speed, or combinations thereof of said main rotary element, said lance mount arrangement, or combinations thereof, said rotation detection arrangement is configured to limit a rotation of said main rotary element about said main rotary axis to less than 360°, said drive motor assembly and said rotation detection arrangement configured to cause said main rotary element to rotate in a clockwise and a counterclockwise direction, said rotation detection arrangement includes a first sensor spaced from said main rotary element and a first detection structure positioned on said main rotary element, said first sensor configured to detect said first detection structure at certain positions of said main rotary element during said rotation of said main rotary element.

2. The lance drive system as defined in claim 1, wherein said main rotary element includes a plurality of teeth on an outer peripheral surface, said teeth configured to engage a gear of said drive motor assembly, at least a portion of said lance mount arrangement connected to a top surface, a bottom surface, or combinations thereof of said main rotary element.

3. The lance drive system as defined in claim 1, wherein said lance longitudinal axis and said main rotary axis are parallel to to one another when the lance is releasably connected to said lance mount arrangement, said lance longitudinal axis and said main rotary axis do not lie on the same axis.

4. The lance drive system as defined in claim 2, wherein said lance longitudinal axis and said main rotary axis are parallel to one another when the lance is releasably connected to said lance mount arrangement, said lance longitudinal axis and said main rotary axis do not lie on the same axis.

5. The lance drive system as defined in claim 1, wherein said first sensor is connected to said main housing support, said first detection structure positioned on a top or bottom surface of said main rotary element.

6. The lance drive system as defined in claim 4, wherein said first sensor is connected to said main housing support, said first detection structure positioned on a top or bottom surface of said main rotary element.

7. The lance drive system as defined in claim 5, wherein said rotation detection arrangement includes a second sensor spaced from said main rotary element and a second detection structure positioned on said main rotary element, said second sensor configured to detect said second detection structure at certain positions of said main rotary element during said rotation of said main rotary element.

8. The lance drive system as defined in claim 6, wherein said rotation detection arrangement includes a second sensor spaced from said main rotary element and a second detection structure positioned on said main rotary element, said second sensor configured to detect said second detection structure at certain positions of said main rotary element during said rotation of said main rotary element.

9. The lance drive system as defined in claim 1, wherein said lance mount arrangement includes a mount base member and a mount top member, said mount top member pivotally connected to said main support housing, said mount base member connected to said main rotary element, each of said mount base member and said mount top member including a gate member that is movable between an open and closed position, said gate member in said closed position configured to secure the lance to said lance mount arrangement.

10. The lance drive system as defined in claim 8, wherein said lance mount arrangement includes a mount base member and a mount top member, said mount base member and said mount top member spaced apart from one another, said mount top member pivotally connected to said main support housing, said mount base member connected to said main rotary element, each of said mount base member and said mount top member including a gate member that is movable between an opened and closed position, said gate member in said closed position configured to secure the lance to said lance mount arrangement.

11. The lance drive system as defined in claim 9, wherein said lance mount arrangement includes a mount support member that is connected to each of said gate members of said mount base member and said mount top member, said mount support member configured to cause said gate members on said mount base member and said mount top member to simultaneously move between said opened and said closed positions.

12. The lance drive system as defined in claim 10, wherein said lance mount arrangement includes a mount support member that is connected to each of said gate members of said mount base member and said mount top member, said mount support member configured to cause said gate members on said mount base member and said mount top member to simultaneously move between said opened and said closed positions.

13. The lance drive system as defined in claim 11, wherein each of said mount base member and said mount top member on said lance mount arrangement includes a pivotally connected gate flange, said gate flange on said mount base member configured to engage said gate member on said mount base member when said gate member on said mount base member is in said closed position, a gate locking arrangement is configured to lock together said gate flange and said gate member on said mount base member when said gate flange and said gate member are in said closed position, said gate flange on said mount top member configured to engage said gate member on said mount top member when said gate member on said mount top member is in said closed position, a gate locking arrangement is configured to lock together said gate flange and said gate member on said mount top member when said gate flange and said gate member are in said closed position.

14. The lance drive system as defined in claim 12, wherein each of said mount base member and said mount top member on said lance mount arrangement includes a pivotally connected gate flange, said gate flange on said mount base member configured to engage said gate member on said mount base member when said gate member on said mount base member is in said closed position, a gate locking arrangement is configured to lock together said gate flange and said gate member on said mount base member when said gate flange and said gate member are in said closed position, said gate flange on said mount top member configured to engage said gate member on said mount top member when said gate member on said mount top member is in said closed position, a gate locking arrangement is configured to lock together said gate flange and said gate member on said mount top member when said gate flange and said gate member are in said closed position.

15. The lance drive system as defined in claim 1, wherein said lance mount arrangement includes a main lance support that is connected to said main rotary element and extends through said main rotary element to be rotatably supported by an upper portion of said main support housing, said main lance support having a longitudinal axis that is parallel to and aligned with said main rotary axis, said main lance support configured to rotate with said main rotary element, a mount base member and a mount top member are rigidly connected to said main lance support and are positioned below and are spaced from said main rotary element, each of said mount base member and said mount top member including a gate member that is movable between an open and closed position, said gate member in said closed position configured to secure the lance to said lance mount arrangement.

16. The lance drive system as defined in claim 8, wherein said lance mount arrangement includes a main lance support that is connected to said main rotary element and extends through said main rotary element to be rotatably supported by an upper portion of said main support housing, said main lance support having a longitudinal axis that is parallel to and aligned with said main rotary axis, said main lance support configured to rotate with said main rotary element, a mount base member and a mount top member are rigidly connected to said main lance support and are positioned below and are spaced from said main rotary element, each of said mount base member and said mount top member including a gate member that is movable between an open and closed position, said gate member in said closed position configured to secure the lance to said lance mount arrangement.

17. The lance drive system as defined in claim 15, wherein each of said mount base member and said mount top member on said lance mount arrangement includes a pivotally connected gate flange, said gate flange on said mount base member configured to engage said gate member on said mount base member when said gate member on said mount base member is in said closed position, a gate locking arrangement is configured to lock together said gate flange and said gate member on said mount base member when said gate flange and said gate member are in said closed position, said gate flange on said mount top member configured to engage said gate member on said mount top member when said gate member on said mount top member is in said closed position, a gate locking arrangement is configured to lock together said gate flange and said gate member on said mount top member when said gate flange and said gate member are in said closed position.

18. The lance drive system as defined in claim 16, wherein each of said mount base member and said mount top member on said lance mount arrangement includes a pivotally connected gate flange, said gate flange on said mount base member configured to engage said gate member on said mount base member when said gate member on said mount base member is in said closed position, a gate locking arrangement is configured to lock together said gate flange and said gate member on said mount base member when said gate flange and said gate member are in said closed position, said gate flange on said mount top member configured to engage said gate member on said mount top member when said gate member on said mount top member is in said closed position, a gate locking arrangement is configured to lock together said gate flange and said gate member on said mount top member when said gate flange and said gate member are in said closed position.

19. The lance drive system as defined in claim 15, wherein a top portion of said main lance support has a circular cross-section shape and a lower portion of said main lance support has a non-circular cross-section shape.

20. The lance drive system as defined in claim 18, wherein a top portion of said main lance support has a circular cross-section shape and a lower portion of said main lance support has a non-circular cross-section shape.

21. A lance drive system for moving an injection lance, said lance drive system comprising:

a main support housing, a main rotary element rotatably secured to said main support housing and configured to rotate about a main rotary axis, said main rotary element includes a plurality of teeth on an outer peripheral surface;

a lance mount arrangement, said lance mount arrangement connected to said main rotary element and to said main support housing, said lance mount arrangement configured to releasably connect to a lance having a lance longitudinal axis, at least a portion of said lance mount arrangement connected to a top surface, a bottom surface, or combinations thereof of said main rotary element, said lance longitudinal axis and said main rotary axis are parallel to one another when the lance is releasably connected to said lance mount arrangement, said lance longitudinal axis and said main rotary axis do not lie on the same axis;

a drive motor assembly, said drive motor assembly including a drive motor, said drive motor configured to cause said main rotary element to rotate at least partially about said main rotary axis, said plurality of teeth on said main rotary element configured to engage a gear of said drive motor assembly; and, a rotation detection arrangement, said rotation detection arrangement configured to detect or determine a rotational position, a rotational direction, a rotation speed, or combinations thereof of said main rotary element, said lance mount arrangement, or combinations thereof, said rotation detection arrangement is configured to limit a rotation of said main rotary element about said main rotary axis to less than 360°, said drive motor assembly and said rotation detection arrangement configured to cause said main rotary element to rotate in a clockwise and a counterclockwise direction, said rotation detection arrangement includes a first sensor and a second sensor, said first sensor spaced from said main rotary element and a first detection structure positioned on said main rotary element, said first sensor configured to only detect said first detection structure at certain positions of said main rotary element during said rotation of said main rotary element, said second sensor spaced from said main rotary element and a second detection structure positioned on said main rotary element, said second sensor configured to only detect said second detection structure at certain positions of said main rotary element during said rotation of said main rotary element.

22. The lance drive system as defined in claim 21, wherein said first sensor and said second sensor connected to said main housing support, said first and second detection structure positioned on a top or bottom surface of said main rotary element.

23. The lance drive system as defined in claim 21, wherein said lance mount arrangement includes a mount base member and a mount top member, said mount top member pivotally connected to said main support housing, said mount base member connected to said main rotary element, each of said mount base member and said mount top member including a gate member that is movable between opened and closed position, said gate member in said closed position configured to secure the lance to said lance mount arrangement.

24. The lance drive system as defined in claim 22, wherein said lance mount arrangement includes a mount base member and a mount top member, said mount top member pivotally connected to said main support housing, said mount base member connected to said main rotary element, each of said mount base member and said mount top member including a gate member that is movable between opened and closed position, said gate member in said closed position configured to secure the lance to said lance mount arrangement.

25. The lance drive system as defined in claim 21, wherein said lance mount arrangement includes a mount base member and a mount top member, said mount base member and said mount top member spaced apart from one another, said mount top member pivotally connected to said main support housing, said mount base member connected to said main rotary element, each of said mount base member and said mount top member including a gate member that is movable between opened and closed position, said gate member in said closed position configured to secure the lance to said lance mount arrangement.

26. The lance drive system as defined in claim 22, wherein said lance mount arrangement includes a mount base member and a mount top member, said mount base member and said mount top member spaced apart from one another, said mount top member pivotally connected to said main support housing, said mount base member connected to said main rotary element, each of said mount base member and said mount top member including a gate member that is movable between opened and closed position, said gate member in said closed position configured to secure the lance to said lance mount arrangement.

27. The lance drive system as defined in claim 23, wherein said lance mount arrangement includes a mount support member that is connected to each of said gate members of said mount base member and said mount top member, said mount support member configured to cause said gate members on said mount base member and said mount top member to simultaneously move between said opened and said closed positions.

28. The lance drive system as defined in claim 25, wherein said lance mount arrangement includes a mount support member that is connected to each of said gate members of said mount base member and said mount top member, said mount support member configured to cause said gate members on said mount base member and said mount top member to simultaneously move between said opened and said closed positions.

29. The lance drive system as defined in claim 23, wherein each of said mount base member and said mount top member on said lance mount arrangement includes a pivotally connected gate flange, said gate flange on said mount base member configured to engage said gate member on said mount base member when said gate member on said mount base member is in said closed position, a gate locking arrangement is configured to lock together said gate flange and said gate member on said mount base member when said gate flange and said gate member are in said closed position, said gate flange on said mount top member configured to engage said gate member on said mount top member when said gate member on said mount top member is in said closed position, a gate locking arrangement is configured to lock together said gate flange and said gate member on said mount top member when said gate flange and said gate member are in said closed position.

30. The lance drive system as defined in claim 25, wherein each of said mount base member and said mount top member on said lance mount arrangement includes a pivotally connected gate flange, said gate flange on said mount base member configured to engage said gate member on said mount base member when said gate member on said mount base member is in said closed position, a gate locking arrangement is configured to lock together said gate flange and said gate member on said mount base member when said gate flange and said gate member are in said closed position, said gate flange on said mount top member configured to engage said gate member on said mount top member when said gate member on said mount top member is in said closed position, a gate locking arrangement is configured to lock together said gate flange and said gate member on said mount top member when said gate flange and said gate member are in said closed position.

31. The lance drive system as defined in claim 21, wherein said lance mount arrangement includes a main lance support that is connected to said main rotary element and extends through said main rotary element to be rotatably supported by an upper portion of said main support housing, said main lance support having a longitudinal axis that is parallel to and aligned with said main rotary axis, said main lance support configured to rotate with said main rotary element, a mount base member and a mount top member are rigidly connected to said main lance support and are positioned below and are spaced from said main rotary element, each of said mount base member and said mount top member including a gate member that is movable between opened and closed position, said gate member in said closed position configured to secure the lance to said lance mount arrangement.

32. The lance drive system as defined in claim 31, wherein each of said mount base member and said mount top member on said lance mount arrangement includes a pivotally connected gate flange, said gate flange on said mount base member configured to engage said gate member on said mount base member when said gate member on said mount base member is in said closed position, a gate locking arrangement is configured to lock together said gate flange and said gate member on said mount base member when said gate flange and said gate member are in said closed position, said gate flange on said mount top member configured to engage said gate member on said mount top member when said gate member on said mount top member is in said closed position, a gate locking arrangement is configured to lock together said gate flange and said gate member on said mount top member when said gate flange and said gate member are in said closed position.

33. The lance drive system as defined in claim 32, wherein a top portion of said main lance support has a circular cross-section shape and a lower portion of said main lance support has a non-circular cross-section shape.

* * * * *